US009782005B2

(12) United States Patent
Paul et al.

(10) Patent No.: US 9,782,005 B2
(45) Date of Patent: Oct. 10, 2017

(54) MEDICAL SUPPORT APPARATUS

(71) Applicant: Stryker Corporation, Kalamazoo, MI (US)

(72) Inventors: Anish Paul, Portage, MI (US); Christopher Stuart Hough, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 146 days.

(21) Appl. No.: 14/801,167

(22) Filed: Jul. 16, 2015

(65) Prior Publication Data

US 2016/0022039 A1 Jan. 28, 2016

Related U.S. Application Data

(60) Provisional application No. 62/029,142, filed on Jul. 25, 2014.

(51) Int. Cl.

| | |
|---|---|
| ***A47C 1/034*** | (2006.01) |
| ***A61G 5/00*** | (2006.01) |
| ***A61G 5/14*** | (2006.01) |
| ***A47C 1/035*** | (2006.01) |
| ***A47C 7/50*** | (2006.01) |

(Continued)

(52) U.S. Cl.

CPC ..... *A47C 1/0342* (2013.01); *A47C 1/035* (2013.01); *A47C 7/506* (2013.01); *A61G 5/006* (2013.01); *A61G 5/14* (2013.01); *A61G 7/005* (2013.01); *A61G 7/012* (2013.01); *A61G 7/015* (2013.01); *A61G 7/018* (2013.01); *A61G 2203/20* (2013.01)

(58) Field of Classification Search

None

See application file for complete search history.

(56) References Cited

U.S. PATENT DOCUMENTS

| | | | |
|---|---|---|---|
| 3,220,019 | A | 11/1965 | Nelson |
| 3,804,460 | A | 4/1974 | Leffler |

(Continued)

FOREIGN PATENT DOCUMENTS

| | | | |
|---|---|---|---|
| EP | 1975750 | A2 | 10/2008 |

OTHER PUBLICATIONS

European Search Report, dated Nov. 27, 2015, for European patent application EP 15177567, corresponding to U.S. Appl. No. 14/801,167.

*Primary Examiner* — David E Allred

(74) *Attorney, Agent, or Firm* — Warner Norcross & Judd LLP

(57) ABSTRACT

A chair includes a seat, a backrest, and a leg rest. A tilt actuator and lift actuator tilt and lift the seat, respectively. A leg rest actuator extends and retracts the leg rest. A backrest actuator pivots the backrest with respect to the seat. A controller simultaneously controls the actuators such that they move sequentially between multiple predefined states. A control panel enables a user to automatically move the chair to any of the predefined states. Progress indicators are included that provide a visual indication of how far the chair has progressed to a commanded state. A controller controls the actuators such that they simultaneously arrive at each state. One or more functions on a control panel may also be automatically disabled and/or automatically enabled as the chair moves into or out of certain ones of the predefined states.

21 Claims, 17 Drawing Sheets

(51) Int. Cl.

| | |
|---|---|
| *A61G 7/005* | (2006.01) |
| *A61G 7/012* | (2006.01) |
| *A61G 7/015* | (2006.01) |
| *A61G 7/018* | (2006.01) |

(56) References Cited

U.S. PATENT DOCUMENTS 3,806,109 A 4/1974 Weber et al.
3,913,153 A 10/1975 Adams et al.
3,934,928 A 1/1976 Johnson
4,127,906 A 12/1978 Zur
4,205,665 A 6/1980 Burton
4,276,610 A 6/1981 Fleck
4,339,013 A 7/1982 Weigt
4,371,922 A 2/1983 Fujita et al.
4,385,410 A 5/1983 Elliott et al.
4,435,862 A 3/1984 King et al.
4,445,169 A 4/1984 Wakita et al.
4,492,407 A 1/1985 Broadhead
4,504,900 A 3/1985 Yomogida et al.
4,619,006 A 10/1986 Magnoni et al.
4,658,347 A 4/1987 Kuze
4,833,589 A * 5/1989 Oshiga ..... G05B 19/054 700/27
4,926,308 A 5/1990 Giles et al.
5,015,035 A 5/1991 Stoeckl et al.
5,059,871 A * 10/1991 Pearlman ..... G05B 19/0421 315/312
5,161,274 A 11/1992 Hayes et al.
5,205,004 A 4/1993 Hayes et al.
5,236,244 A 8/1993 Rice
5,313,574 A 5/1994 Beethe
5,467,002 A 11/1995 Brooks
5,515,561 A 5/1996 Suggitt et al.
5,544,376 A 8/1996 Fromson
5,547,245 A 8/1996 Knouse
5,556,163 A 9/1996 Rogers, III et al.
5,565,895 A 10/1996 Akatsuka
5,623,592 A 4/1997 Carlson et al.
5,625,956 A 5/1997 Cone, II et al.
5,678,264 A 10/1997 Walker
5,715,548 A 2/1998 Weismiller et al.
5,771,511 A 6/1998 Kummer et al.
5,790,997 A 8/1998 Ruehl
5,867,163 A 2/1999 Kurtenbach
5,926,002 A 7/1999 Cavanaugh et al.
6,008,598 A 12/1999 Luff et al.
6,064,932 A * 5/2000 Fran.cedilla.ois ... B60N 2/0228 340/438
6,105,187 A 8/2000 Gnjatovic
6,125,957 A 10/2000 Kauffmann
6,163,903 A 12/2000 Weismiller et al.
6,320,341 B1 11/2001 Oka et al.
6,322,142 B1 11/2001 Yoshida et al.
6,336,235 B1 1/2002 Ruehl
6,351,678 B1 2/2002 Borders
6,378,152 B1 4/2002 Washburn et al.
6,396,224 B1 * 5/2002 Luff ..... A47C 20/048 318/16
6,425,635 B1 7/2002 Pulver
6,439,636 B1 8/2002 Kuo
6,486,792 B1 * 11/2002 Moster ..... A47C 31/008 297/411.2
6,492,786 B1 12/2002 Vang et al.
6,560,492 B2 5/2003 Borders
6,588,792 B1 7/2003 Koerlin et al.
6,609,760 B1 8/2003 Matern et al.
6,640,365 B1 11/2003 Chang
6,688,691 B2 2/2004 Marechal et al.
6,715,784 B2 4/2004 Koerlin et al.
6,763,498 B2 7/2004 Egilsson
6,854,141 B2 2/2005 Nagaoka et al.
6,870,341 B2 3/2005 Nagaoka et al.
6,904,631 B2 6/2005 Vrzalik et al.
6,917,167 B2 7/2005 Courtney et al.
6,957,458 B2 10/2005 Nagaoka et al.
6,957,459 B2 10/2005 Nagaoka et al.
7,058,999 B2 6/2006 Horitani et al.
7,174,588 B1 2/2007 Chen
7,235,942 B2 6/2007 Nagaoka et al.
7,594,286 B2 9/2009 Williams
7,600,817 B2 * 10/2009 Kramer ..... A47C 1/022 297/354.13
7,690,059 B2 * 4/2010 Lemire ..... A61G 7/005 5/600
7,716,762 B2 5/2010 Ferraresi et al.
7,805,784 B2 * 10/2010 Lemire ..... A61G 7/005 108/145
7,861,334 B2 * 1/2011 Lemire ..... A61G 7/005 5/280
7,911,349 B2 3/2011 Zerhusen et al.
7,933,669 B2 4/2011 Rawls-Meehan
7,962,981 B2 * 6/2011 Lemire ..... A61G 7/005 5/600
8,006,332 B2 * 8/2011 Lemire ..... A61G 7/005 5/600
8,046,116 B2 10/2011 Rawls-Meehan
8,056,857 B2 11/2011 Dowty et al.
8,065,024 B2 11/2011 Nagaoka et al.
8,068,924 B2 11/2011 Nagaoka et al.
8,095,278 B2 1/2012 Schaaf et al.
8,215,311 B2 7/2012 Hyde et al.
8,239,087 B2 8/2012 Dybalski et al.
8,334,779 B2 12/2012 Zerhusen et al.
8,393,026 B2 * 3/2013 Dionne ..... A61G 7/005 340/540
8,397,393 B2 3/2013 Johnson et al.
8,499,385 B2 8/2013 Horitani
8,572,778 B2 11/2013 Newkirk et al.
8,584,282 B2 11/2013 Frondorf et al.
8,593,284 B2 11/2013 Tallent et al.
8,604,917 B2 12/2013 Collins et al.
8,674,839 B2 3/2014 Zerhusen et al.
8,701,229 B2 * 4/2014 Lemire ..... A61G 7/005 5/510
8,714,646 B2 * 5/2014 Cvek ..... A47C 1/0242 297/217.3
9,126,571 B2 * 9/2015 Lemire ..... A61G 7/005
9,555,778 B2 * 1/2017 Lemire ..... A61G 7/005
2004/0010850 A1 1/2004 Nagaoka et al.
2004/0010851 A1 1/2004 Nagaoka et al.
2004/0015320 A1 1/2004 Nagaoka et al.
2004/0195875 A1 10/2004 Skelly
2004/0216235 A1 11/2004 Rees
2005/0273933 A1 12/2005 Nagaoka et al.
2006/0117482 A1 6/2006 Branson
2009/0151074 A1 6/2009 Nagaoka et al.
2010/0176632 A1 7/2010 Alford et al.
2012/0023670 A1 2/2012 Zerhusen et al.
2012/0089419 A1 4/2012 Huster et al.
2014/0026322 A1 1/2014 Bell et al.
2014/0059770 A1 3/2014 Williamson et al.
2014/0124274 A1 5/2014 Zerhusen et al.
2014/0137025 A1 5/2014 Newkirk et al.
2016/0287459 A1 * 10/2016 Lemire ..... A61G 7/005

* cited by examiner

| Actuator Length by State | | | | | | |
|---|---|---|---|---|---|---|
| | State 1 | State 2 | State 3 | State 4 | State 5 | State 6 |
| | Trend | Flat | Recline | Upright 2 | Upright 1 | Stand |
| Backrest Actuator | 12.571 | 12.571 | 15.123 | 16.332 | 17.204 | 15.365 |
| Seat Actuator | 10.344 | 11.189 | 10.065 | 10.593 | 10.799 | 12.439 |
| Footrest Actuator | 15.88 | 15.88 | 15.262 | 15.555 | 11.624 | 12.848 |
| Lift Actuator | 14.932 | 13.952 | 12.438 | | 12.438 | 14.932 |

All measurements are inches

No target for State 4; Lift is not driven when moving to state 4 from state 3 or 5 (No lift motion 3 -> 4 or for 5 -> 4)
No target for moving from State 4 to State 3, Target only for moving from State 2 to State 3; Lift is not driven when moving from State 4 to State 3 (2 -> 3 has a target, 4 -> 3 has not lift motion)
No target for moving from State 4 to State 5, Target only for moving from State 6 to State 5; Lift is not driven when moving from State 4 to State 5 (6 -> 5 has a target, 4 -> 5 has not lift motion)

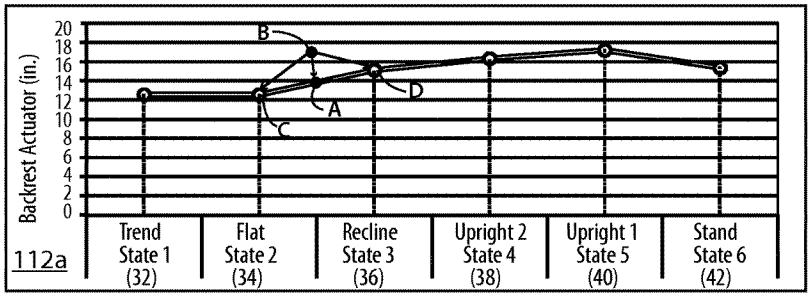

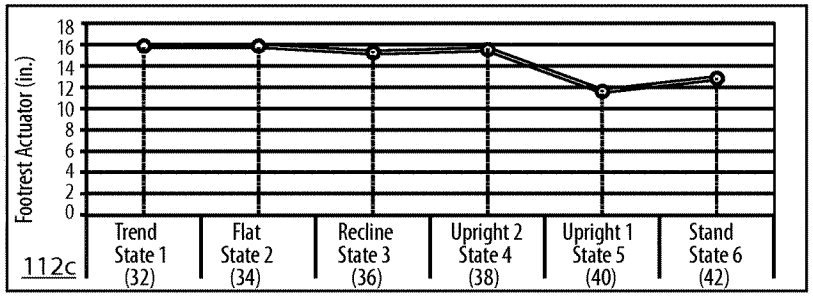

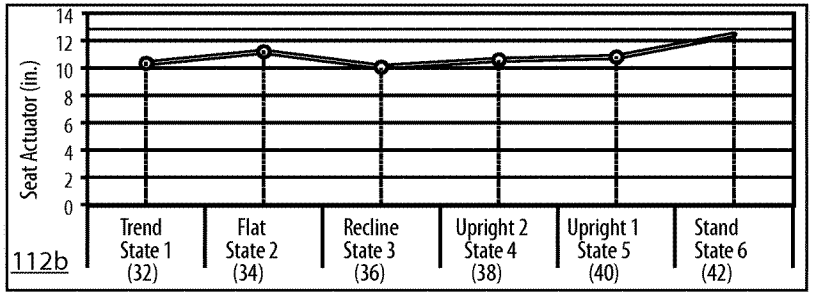

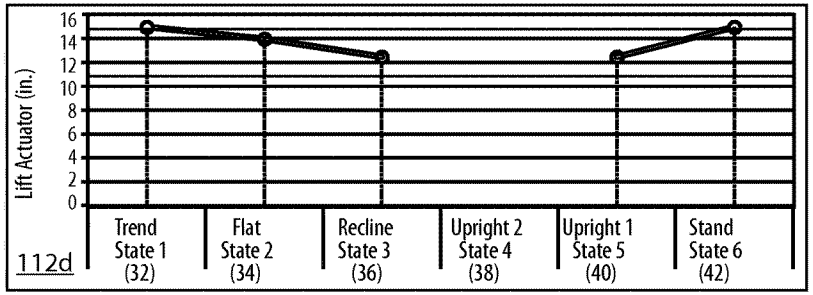

FIG. 13

| Independent Lift Motion by State | | | | | | |
|---|---|---|---|---|---|---|
| | State 1 | State 2 | State 3 | State 4 | State 5 | State 6 |
| | Trend | Flat | Recline | Upright 2 | Upright 1 | Stand |
| Lift Height Adjustment - Max | 25 | 25 | 25 | 25 | 25 | 25 |
| Lift Height Adjustment - Min | 25 | 23 | 17.5 | 17.5 | 17.5 | 25 |

All measurements are inches from the floor

**Lifts may be independantly moved in any position between two curves below

MEDICAL SUPPORT APPARATUS

CROSS-REFERENCE TO RELATED APPLICATIONS

This application claims priority to U.S. provisional patent application Ser. No. 62/029,142 filed Jul. 25, 2014 by inventors Anish Paul et al. and entitled MEDICAL SUPPORT APPARATUS, the complete disclosure of which is hereby incorporated herein by reference.

TECHNICAL FIELD AND BACKGROUND

The present disclosure relates to a patient support apparatus, and more particularly to a medical recliner chair.

It is well known in the medical field that a patient's recovery time can be improved if the patient becomes more mobile. To that end, it is desirable for a patient to move in and out of the hospital bed on which he or she is most typically positioned. Providing a chair for the patient encourages movement from the bed to the chair and vice versa. The present disclosure relates to a chair that can comfortably support the patient and that better accommodates the patient's and/or the caregiver's needs.

SUMMARY

According to one embodiment, a chair is provided that includes a base, a seat supported on the base, a backrest, a leg rest, a controller, and a control panel. The backrest is pivotable to different angular orientations with respect to the base. The leg rest is extendible and retractable to different positions with respect to the seat. The controller is adapted to move the chair from a first state to a second state wherein the first state is defined by a first orientation of the backrest and a first position of the leg rest, and the second state is defined by a second orientation of the backrest and a second position of the leg rest. The control panel is in communication with the controller and is adapted to allow a user to move the chair from the first state to the second state. The control panel further includes a visual indicator that provides a visual indication of how far the chair has progressed when moving from the first state to the second state.

According to another embodiment, a chair is provided that includes a base, a seat supported on the base, a backrest, a leg rest, a control panel, and a controller. The backrest is pivotable to different angular orientations with respect to the base. The leg rest is extendible and retractable to different positions with respect to the seat. The control panel includes first, second, third, and fourth controls, and the controller is adapted to move the chair to a first state when the first control is pressed, to move the chair to a second state when the second control is pressed, to move the chair to a third state when the third control is pressed, and to move the chair to a fourth state when the fourth control is pressed. The controller is further adapted to move the chair from the first state to the fourth state only by moving the chair through the second and third states.

In other embodiments, the control panel further comprises at least three lights arranged in a line, a first icon positioned adjacent a first one of the lights and corresponding to the first state, and a second icon positioned adjacent a second one of the lights and corresponding to the second state. The control panel selectively illuminates one of the lights based upon a current orientation of the backrest and current position of the leg rest.

In another embodiment, the first icon is positioned at or near a first control on the control panel that, when pressed, moves the chair to the first state, and the second icon is positioned at or near a second control on the control panel that, when pressed, moves the chair to the second state. In one embodiment the controls are dedicated buttons, while in other embodiments the controls are areas on a touch screen. In still other embodiments, the controls may be switches, dials, lever, or the like.

In another embodiment, the controller is further adapted to move the chair from the second state to a third state, from the third state to a fourth state, and from the fourth state to a fifth state; wherein the third, fourth, and fifth states are each defined by third, fourth, and fifth orientations of the backrest and third, fourth, and fifth positions of the leg rest, respectively. Still further, the visual indicator provides visual indications to the user of how far the chair has progressed from any of the first, second, third, fourth, or fifth states to any other of the first, second, third, fourth, or fifth states.

In other embodiments, the movement of the chair between the first and second states utilizes at least two separate actuators, one of which controls movement of the leg rest and the other of which controls movement of the backrest. In still another embodiment, the chair includes a seat actuator and movement of the chair between the first and second states utilizes the seat actuator. In still another embodiment, the chair includes a seat lift actuator and the movement of the chair between the first and second states utilizes the seat lift actuator. In any of these embodiments, the controller may be adapted to control the multiple actuators in such a manner that they all operate simultaneously and are controlled such that they will arrive at the user-directed state simultaneously. That is, the multiple actuators will begin movement at the same time and end movement at the same time. The actuators are therefore controlled in parallel, rather than serially, when transitioning between states, in at least some embodiments.

In another embodiment, the control panel further includes a first icon corresponding to the first state and a first light positioned adjacent to the first icon. A second icon corresponding to the second state is also included and is positioned adjacent to a second light. A plurality of intermediate lights are also positioned between the first and second lights, and the control panel illuminates the first light when the chair is in the first state, illuminates the second light when the chair is in the second state, and illuminates one of the intermediate lights when the chair is transitioning from the first state to the second state.

In still other embodiments, the first orientation of the backrest is generally upright and the first position of the leg rest is retracted, and the second orientation of the backrest is generally horizontal and the second position of the leg rest is extended.

In yet another embodiment, the first state is defined by a first orientation and first height of the seat and the second state is defined by a second orientation and second height of the seat. The first orientation of the backrest is generally upright, the first position of the leg rest may is retracted, the first orientation of the seat is defined by a forward end of the seat being lower than a rear end of the seat, and the first height of the seat is raised. Still further, the second orientation of the backrest is generally horizontal, the second position of the leg rest is extended, the second orientation of the seat is generally horizontal, and the second height of the seat is lowered.

In other embodiments, the first state corresponds to a state adapted to assist an occupant into a standing position, and the second state corresponds to a state adapted to support the occupant in a Trendelenburg position.

In still other embodiments, the controller is further adapted to allow a user to stop movement of the leg rest and backrest in any desired position intermediate the first and second states, or intermediate any of the third, fourth, and fifth states.

In at least one embodiment, the first state is defined by the following: (1) the backrest is pivoted to a non-vertical angular orientation, (2) the leg rest is extended, and (3) a forward end of the seat is higher than a rearward end of the seat; and the fourth state is defined by the following: (1) the backrest is substantially vertical, (2) the leg rest is retracted, and (3) the forward end of the seat is lower than the rearward end of the seat.

The visual indicator of the control panel may include a plurality of lights arranged in a curved line where the first, second, third, and fourth controls are positioned sequentially along the curved line of lights.

The control panel may further include one or more controls that are automatically enabled or disabled depending upon which state the chair is currently in. Still further, when such a control is automatically disabled, the controller may automatically remove any visual indication of the control from the controller while in the disabled state, and automatically return the visual indication of the control when the controller is in the enabled state. Such removal and return of the visual indications may occur through changing the backlighting of the control, or through changing graphics on a display (such as a liquid crystal display, or other type of display), or by other means.

The control panel, in some embodiments, is positioned along a side of the backrest and adjacent an upper end of the backrest. Still further, in some embodiments, there are two control panels, one along a first side of the upper end of the backrest and the other along a second side of the upper end of the backrest. The two control panels are identical. In still other embodiments, a third control panel is included on or adjacent one of the armrests and is adapted for use by an occupant of the chair. This third control panel includes fewer control options than the control panels mounted adjacent the upper ends of the backrest.

In still another embodiment, the chair includes a first actuator adapted to pivot the backrest to different angular positions, a second actuator adapted to extend and retract the leg rest, and a third actuator adapted to change an angular orientation of the seat. Further, the control panel includes no controls that move the first actuator without also simultaneously moving at least one of the second and third actuators.

In still another embodiment, the controller is adapted to control the seat actuator, the backrest actuator, and the leg rest actuator such that when moving from a first state to a second state and then to a third state, the controller coordinates the movement of the seat actuator, backrest actuator, and leg rest actuator such that they all arrive at the second state at substantially the same time. Further, after arriving at the second state, the controller coordinates the movement of these three actuators such that they all arrive at the third state at substantially the same time.

In still another embodiment, the controller is adapted to move the chair between first and second states and to automatically disable at least one control on the control panel when the chair is in the first state. Further, the controller is adapted to automatically enable the at least one control on the control panel when the chair is in the second state.

According to yet another embodiment, the controller is adapted to automatically coordinate the movement of all of the seat actuator, lift actuator, backrest actuator, and leg rest actuator from a first state to a second state, and to coordinate the movement of only the seat actuator, backrest actuator, and leg rest actuator (and not the lift actuator) when moving from the second state to the third state.

Before the various embodiments disclosed herein are explained in detail, it is to be understood that the claims are not to be limited to the details of operation or to the details of construction and the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

BRIEF DESCRIPTION OF DRAWINGS

FIG. 13 is a set of diagrams illustrating the position of the backrest actuator, seat actuator, footrest actuator, and seat actuator of the chair when the chair moves between the states illustrated in FIGS. 6-11;

DETAILED DESCRIPTION OF THE EMBODIMENTS

Figure 1:
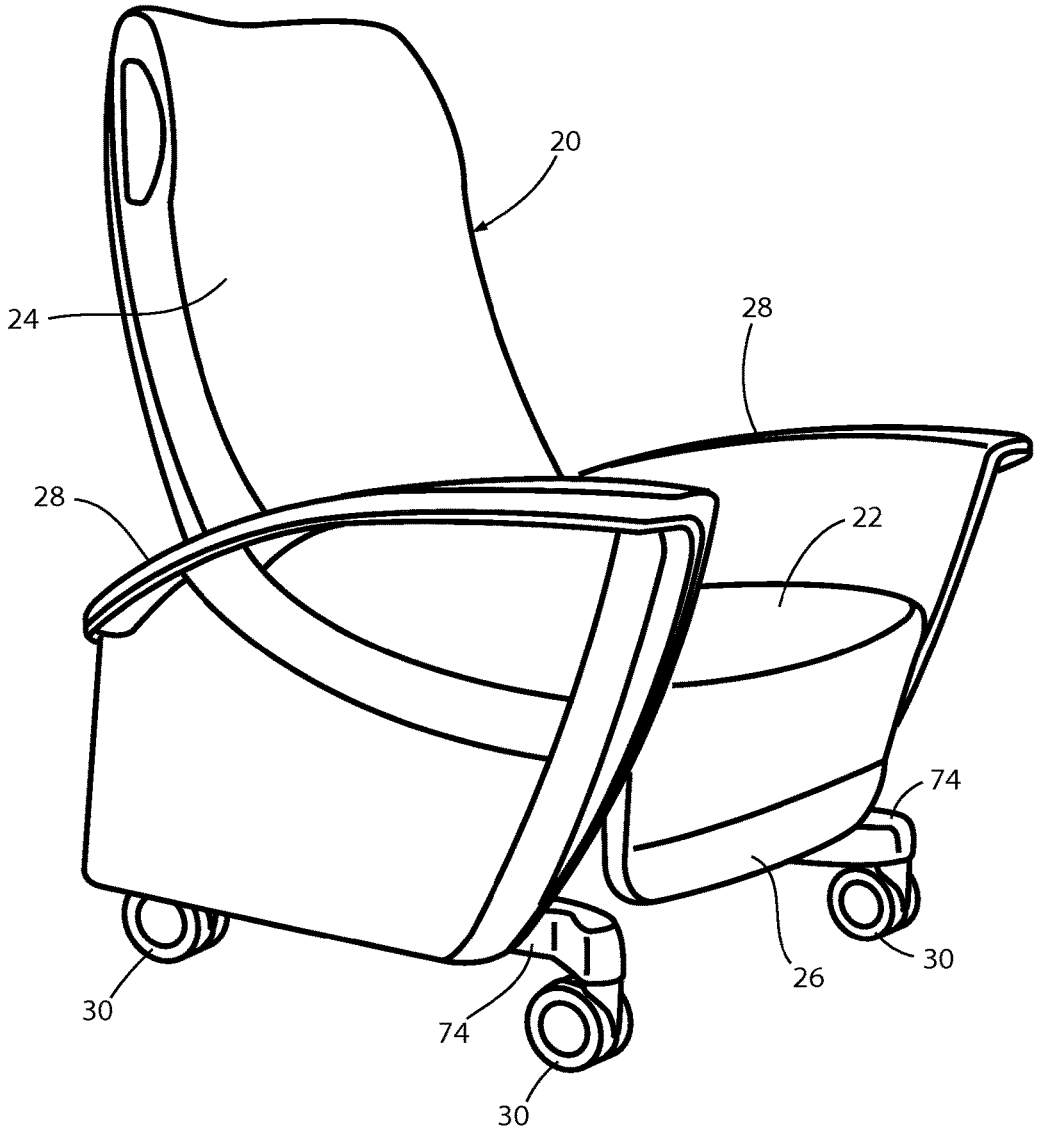
FIG. 1 is a perspective view of a chair according to one embodiment of the present disclosure.

Referring to FIG. 1, a chair 20 according to one embodiment is shown. Although the following written description will be made with respect to a chair, it will be understood by those skilled in the art that the principles disclosed herein may also be incorporated into other types of person support apparatuses besides chairs, such as, but not limited to, beds, stretchers, cots, surgical tables, or the like.

Figure 6:
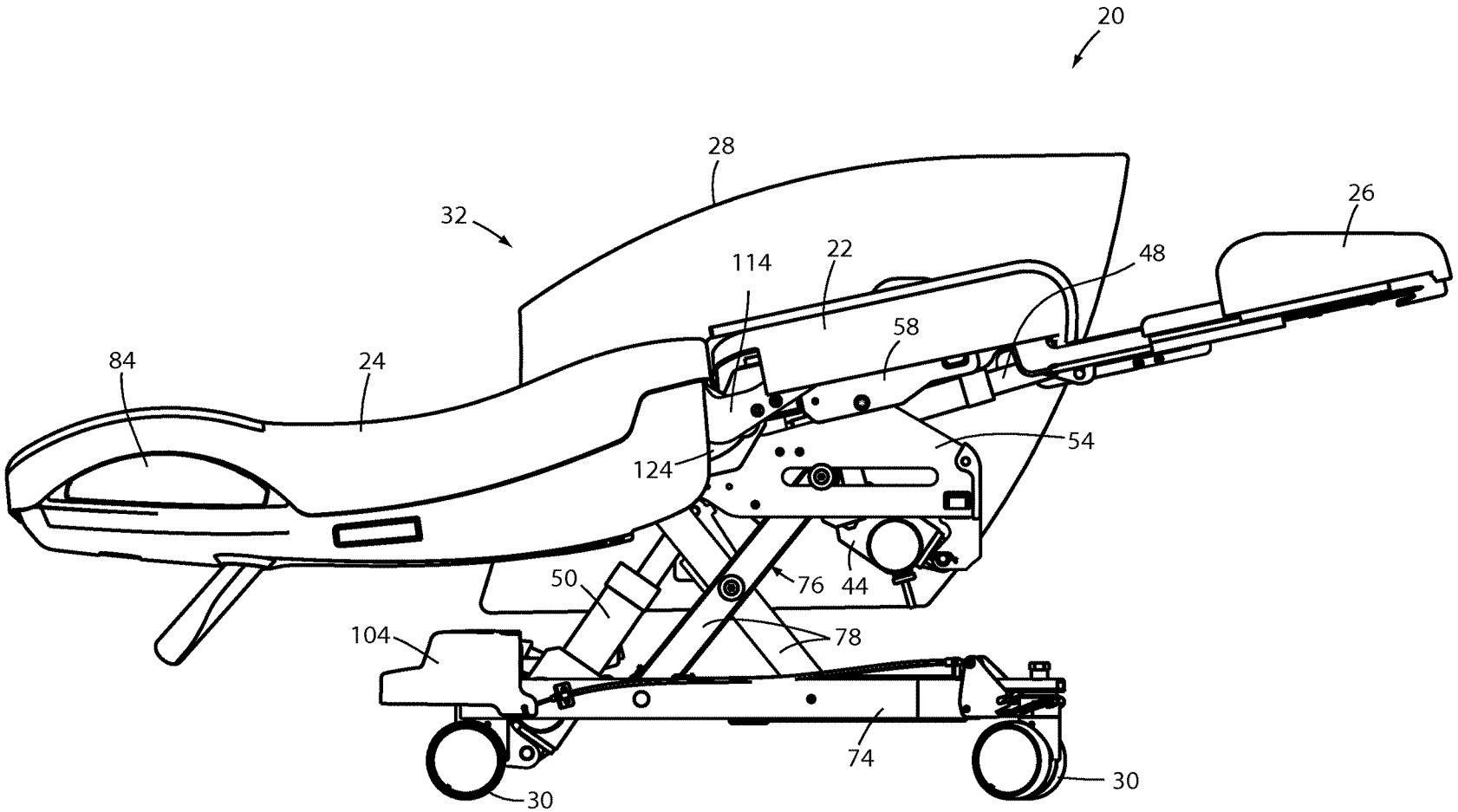
FIG. 6 is a side elevational view of various structural components of the chair of FIG. 1 shown in a Trendelenburg state.
Figure 7:
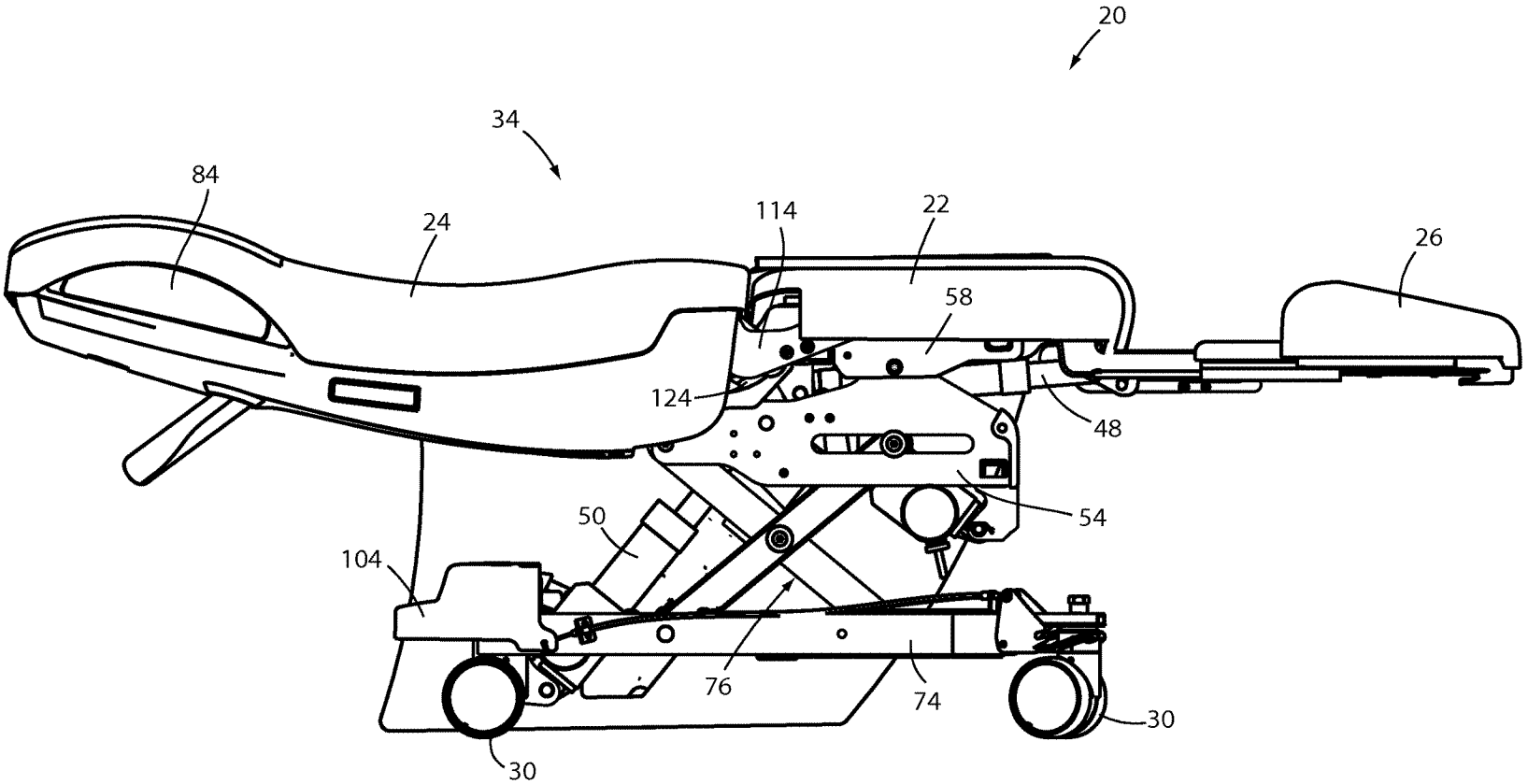
FIG. 7 is a side elevational view of the chair of FIG. 6 shown in a flat state.
Figure 8:
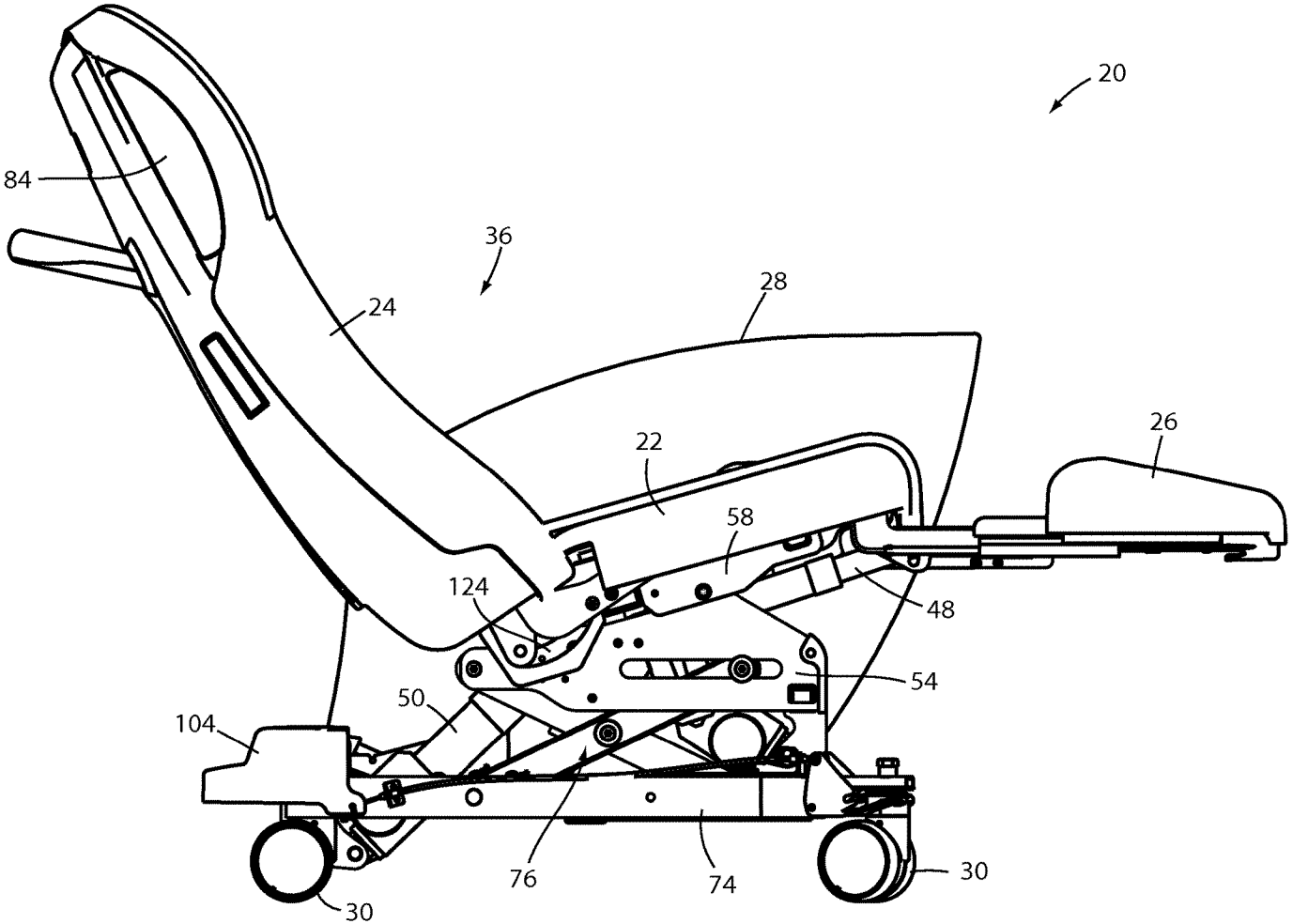
FIG. 8 is a side elevational view of the chair of FIG. 6 shown in a recline state.
Figure 9:
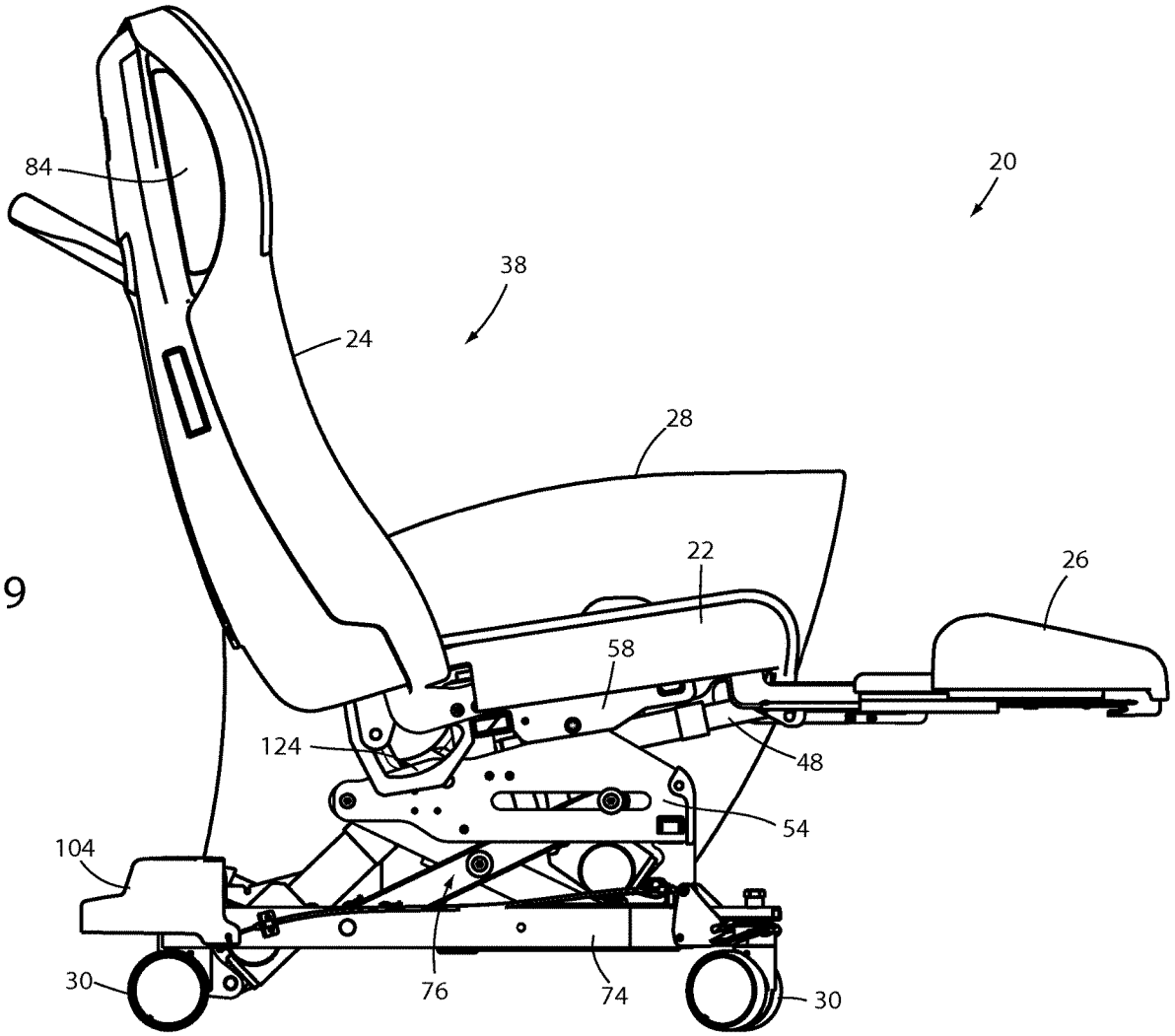
FIG. 9 is a side elevational view of the chair of FIG. 6 shown in a second upright state.
Figure 10:
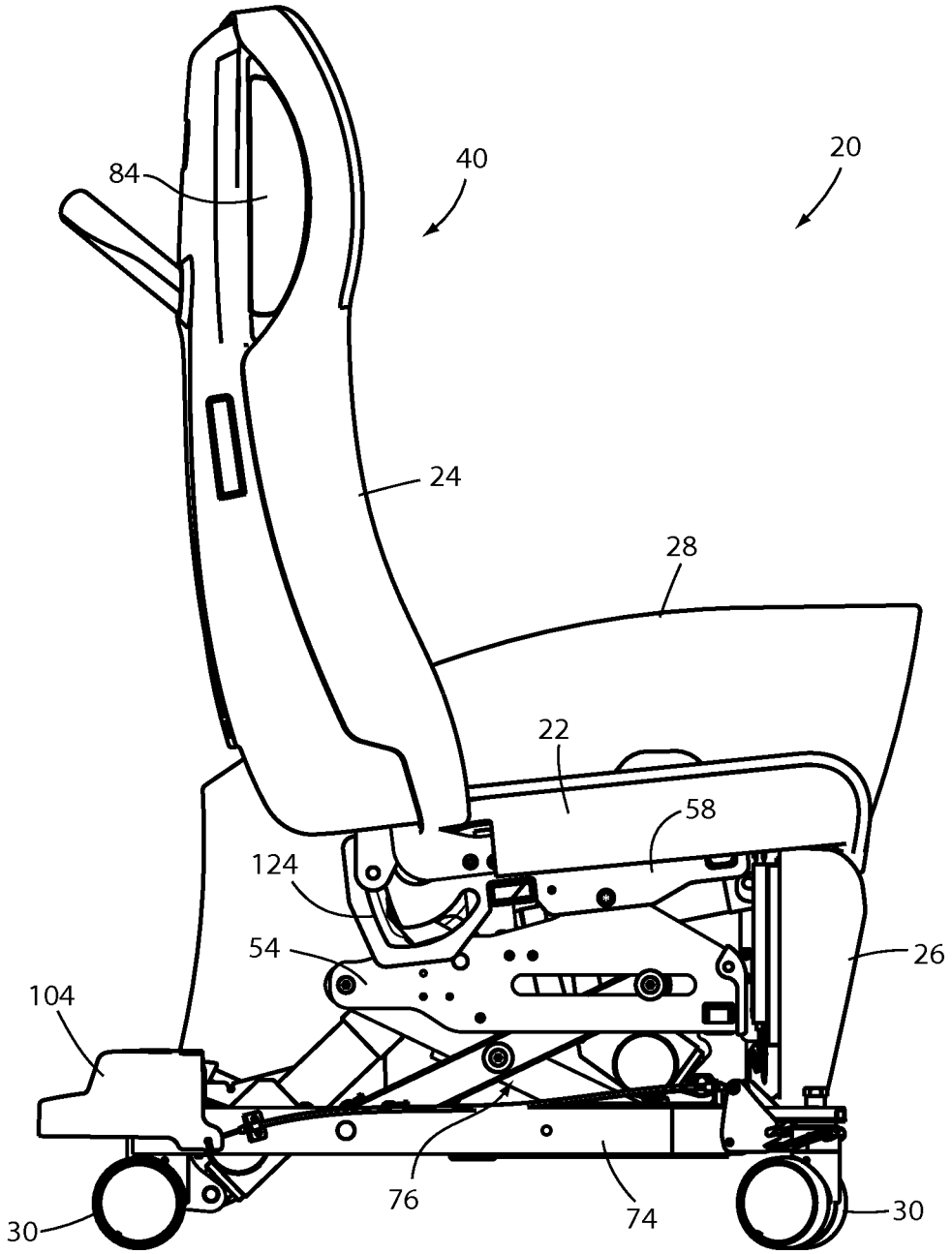
FIG. 10 is a side elevational view of the chair of FIG. 6 shown in a first upright state.
Figure 11:
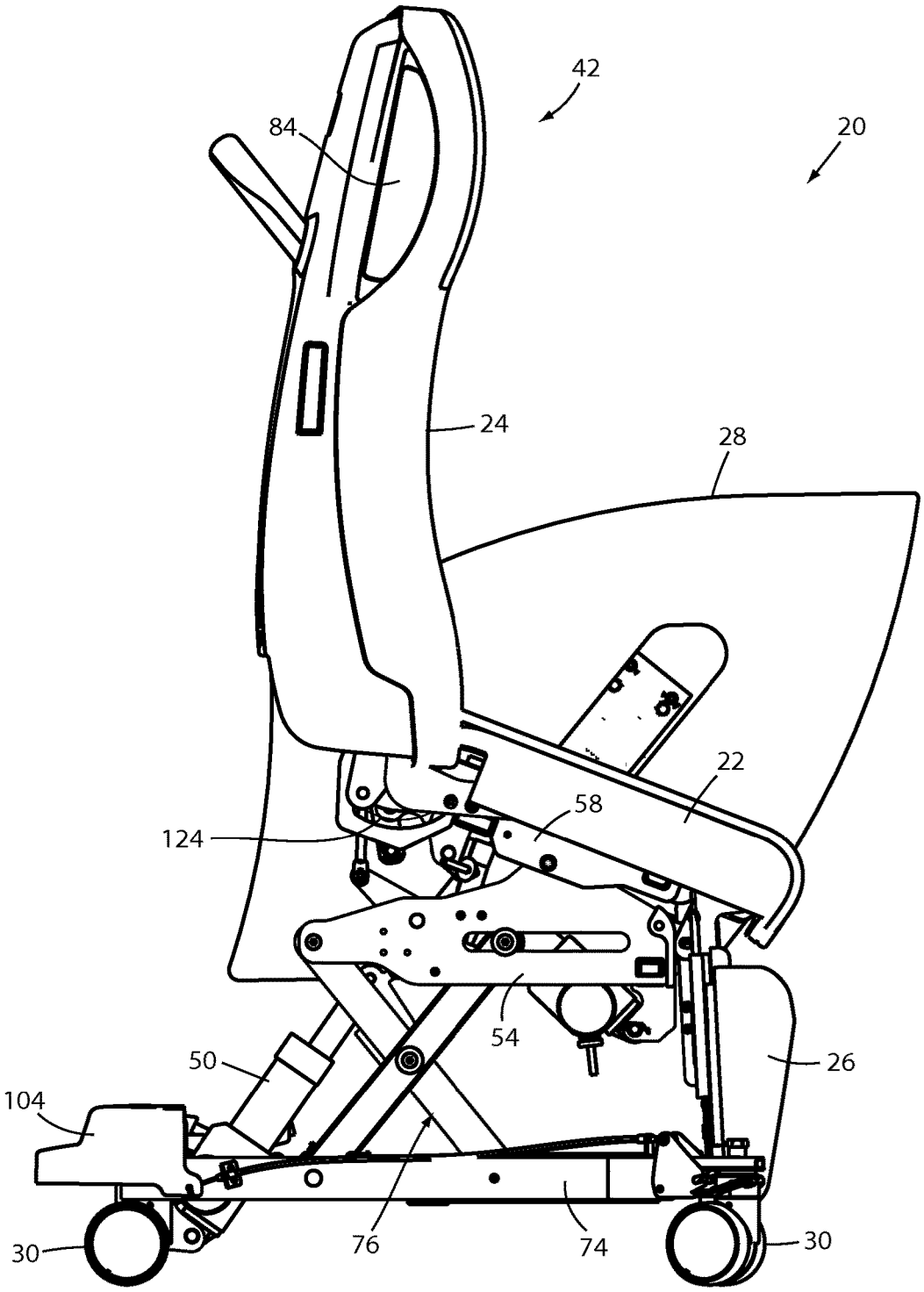
FIG. 11 is a side elevational view of the chair of FIG. 6 shown in a stand state.

Chair 20 includes a seat 22, a backrest 24, a leg rest 26, a pair of armrests 28, and a plurality of wheels 30. Chair 20 is constructed such that both the height and tilt of seat 22 is adjustable. Further, chair 20 is constructed such that backrest 24 is pivotable between a generally upright position, such as shown in FIG. 1, and a rearwardly reclined position, such as shown in FIG. 6. Leg rest 26 is constructed such that it is able to be moved between a retracted position, such as shown in FIG. 1, and an extended position, such as shown in FIG. 8. Armrests 28 may be constructed such that a user can raise and lower their height relative to seat 22. Several manners in which chair 20 may be constructed in order to carry out these various motions of the seat, backrest, and leg rest are described in greater detail below. It will also be understood, however, that in other embodiments, chair 20 may be constructed in accordance with any of the embodiments disclosed in commonly assigned, copending U.S. patent application Ser. No. 14/212,253 filed Mar. 14, 2014 by inventors Christopher Hough et al. and entitled MEDICAL SUPPORT APPARATUS, the complete disclosure of which is incorporated herein by reference.

Figure 2:
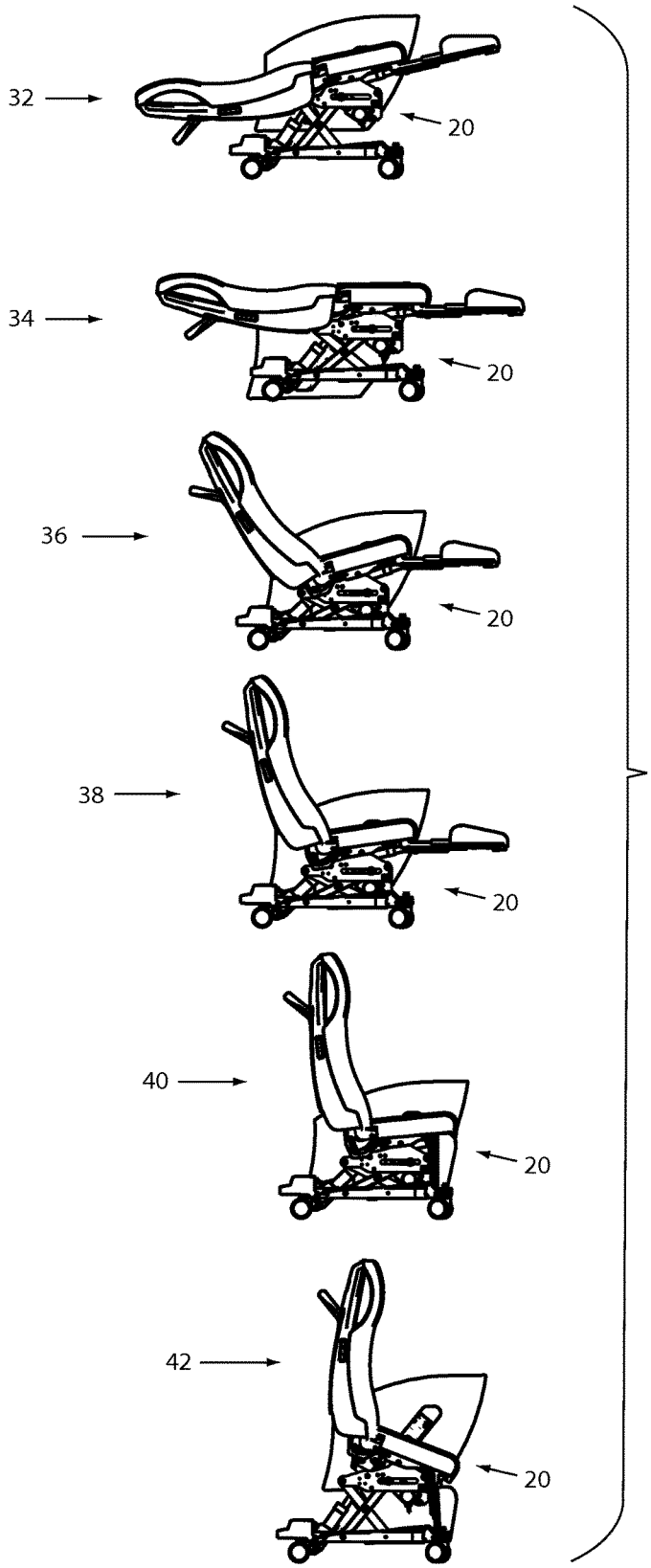
FIG. 2 is a set of side elevational views showing the chair of FIG. 1 in a series of six different states.

FIG. 2 illustrates in greater detail six states that chair 20 can be moved to according to one embodiment. As shown therein, chair 20 is movable to any of a Trendelenburg state 32, a flat state 34, a recline state 36, a second upright state 38, a first upright state 40, and a stand state 42. Further, although not shown in FIG. 2, chair 20 is movable to a virtually infinite number of states that are in between the six states shown in FIG. 2. That is, as will be discussed in greater detail below, a user may operate chair 20 to move it to a state, for example, in which the backrest 24 is positioned at an angle between the backrest angles shown in the flat state 34 and the recline state 36. Once the user moves the chair to such a desired state, the chair remains fixed in that state until the user decides to move the chair to a different state. The manner in which chair 20 is controlled in order to achieve these different states will be described in greater detail below.

Figure 3:
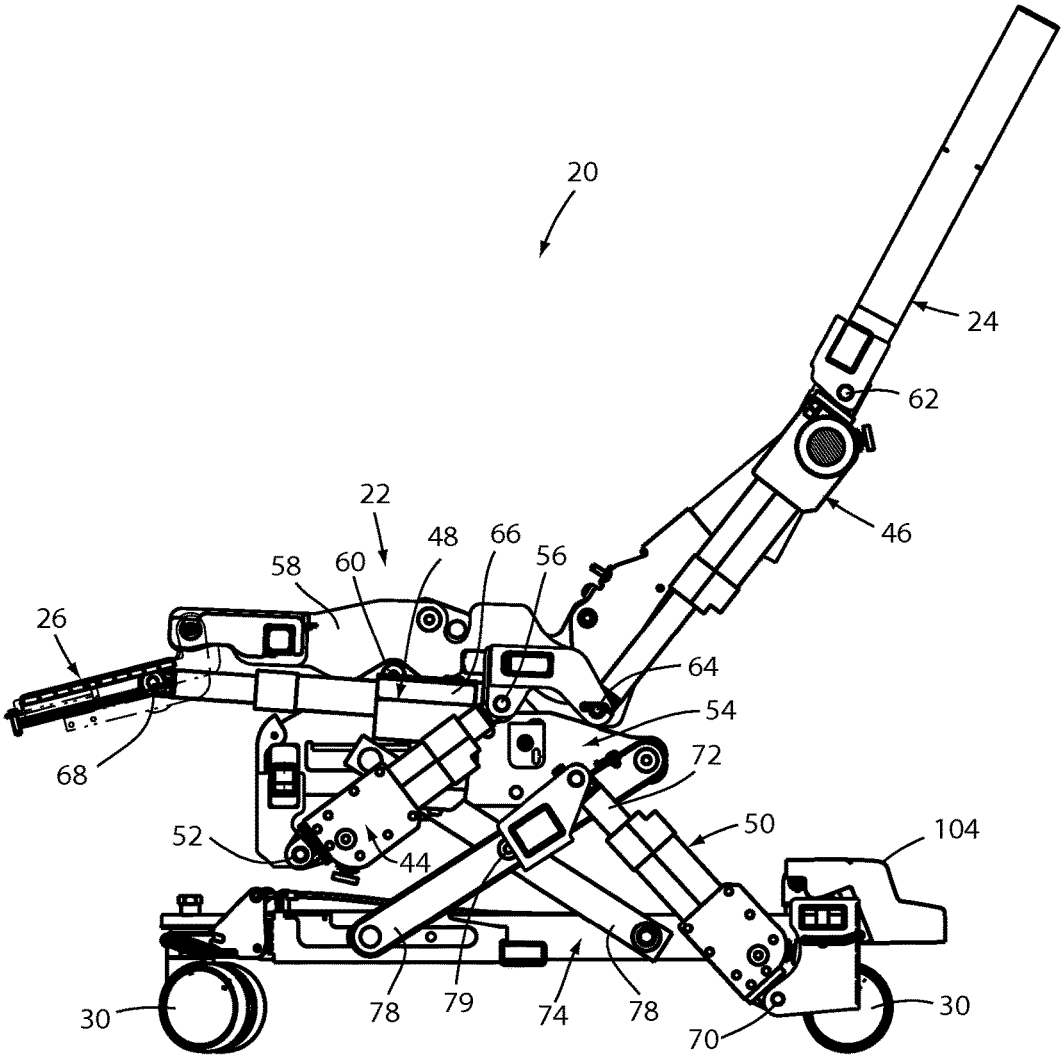
FIG. 3 is a side, sectional view of many of the structural components the chair of FIG. 1, including multiple actuators.

FIG. 3 shows various internal components of chair 20, including a seat actuator 44, a backrest actuator 46, a leg rest actuator 48, and a lift actuator 50. Each of actuators 44, 46, 48, and 50 are motorized linear actuators that are designed to linearly extend and retract under the control of a controller. Seat actuator 44 includes a stationary end 52 that is pivotally mounted to a chassis 54. Seat actuator 44 further includes an extendible end 56 that is pivotally mounted to a seat frame 58. When seat actuator 44 extends or retracts, extendible end 56 causes seat frame 58 to pivot about a seat pivot axis 60. The extension of seat actuator 44 therefore causes seat frame 58 to tilt in such a manner that a forward end of seat 22 moves downward relative to a backward end of seat 22 (i.e. seat frame 58 will rotate in a counterclockwise direction as shown in FIG. 3). The retraction of seat actuator 44 will, in contrast, cause seat frame 58 to tilt in the opposite manner (i.e. seat frame 58 will rotate in a clockwise direction as shown in FIG. 3).

Backrest actuator 46 includes a stationary end 62 that is mounted to backrest 24 and an extendible end 64 that is mounted to seat frame 58. The extension and retraction of backrest actuator 46 will therefore cause backrest 24 to pivot with respect to seat frame 58. More specifically, when backrest actuator 46 extends, backrest 24 will rotate in a counterclockwise direction in FIG. 3. In contrast, when backrest actuator 46 retracts, backrest 24 will rotate in a clockwise direction in FIG. 3. Because backrest 24 is coupled to seat frame 58, the rotation of seat frame 58 by seat actuator 44 will also cause backrest 24 to rotate with respect to the floor as seat frame 58 rotates. This rotation, however, will be independent of the rotation of backrest 24 caused by backrest actuator 46. In other words, the relative angle between backrest 24 and seat 22 will only change when backrest actuator 46 is actuated (and not when seat actuator 44 extends or retracts while backrest actuator 46 does not change length). The angle of backrest 24 with respect to the floor (or another fixed reference), however, will change as seat frame 58 pivots about seat pivot axis 60.

Leg rest actuator 48 includes a stationary end 66 that is mounted to seat frame 58 and an extendible end 68 that is mounted to leg rest 26. The extension of leg rest actuator 48 therefore will pivot leg rest 26 from a retracted position (e.g. FIG. 1) to an extended position, such as shown in FIG. 3. The physical construction of leg rest 26 may take on any of the forms disclosed in the commonly assigned U.S. patent application Ser. No. 14/212,253 mentioned above, whose disclosure is incorporated completely herein by reference. Other physical constructions of leg rest 26 are also possible. The extension and retraction of leg rest actuator 48 will change the orientation of leg rest 26 with respect to seat frame 58. The orientation of leg rest 26 with respect to seat frame 58 will not change based on the extension or contraction of any other actuators 44, 46, or 50. The orientation of leg rest 26 with respect to the floor (or some other fixed reference), however, will change when seat frame 58 is pivoted about seat pivot axis 60 by seat actuator 44. In summary, then, the pivoting of seat frame 58 about its pivot axis 60 will therefore change the orientations of all of seat 22, backrest 24, and leg rest 26 with respect to the floor (or other fixed reference), but will not, by itself, change the orientations of any of these components (seat 22, backrest 24, and leg rest 26) with respect to each other.

Lift actuator 50 includes a stationary end 70 that is coupled to a base 74 and an extendible end 72 that is coupled to an X-frame lift 76. X-frame lift 76 includes two legs 78 that are pivotally coupled to each other about a center axis 79. When lift actuator 50 extends or retracts, the relative angle between each of the legs 78 changes, which changes the overall height of X-frame lift 76. Further, because chassis 54 is mounted on a top end of X-frame lift, the changing height of X-frame lift changes the height of chassis 54. Lift actuator 50 therefore raises the height of chassis 54 when it extends and lowers the height of chassis 54 when it retracts. Because seat frame 58 is mounted (pivotally) on chassis 54, and because backrest 24 and leg rest 26 are both mounted to seat frame 58, raising and lowering the height of chassis 54 simultaneously raises and lowers the height of seat 22, backrest 24, and leg rest 26. However, extending and retracting lift actuator 50 does not, by itself, change the angular orientations of any of leg rest 26, backrest 24, and/or seat 22, either with respect to each other or with respect to the floor.

Figure 4:
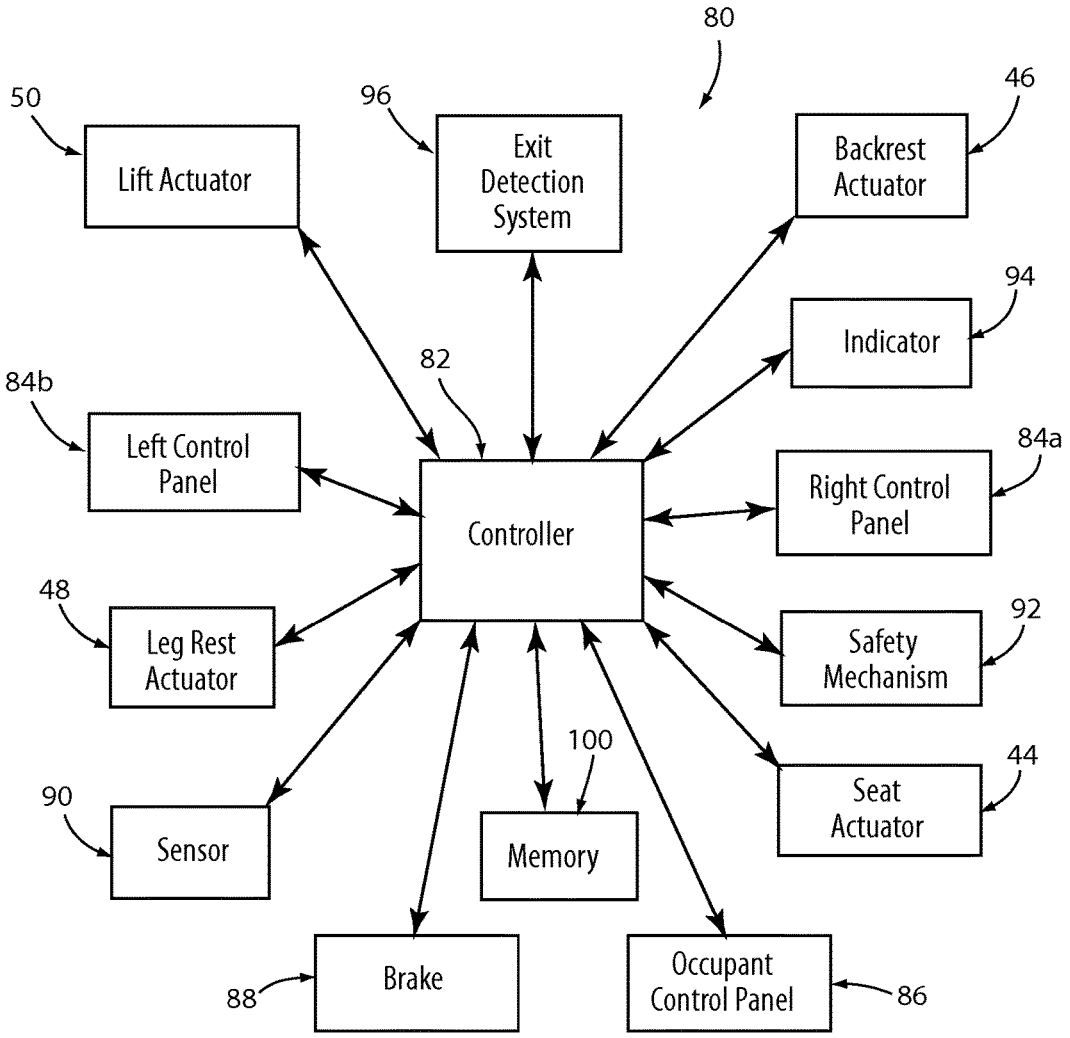
FIG. 4 is a diagram of one embodiment of a control system that can be incorporated into the chair of FIG. 1.

The operation and coordinated movement of actuators 44-50 is carried out via a control system 80. One example of such a control system 80 is depicted in FIG. 4. Control system 80 includes a controller 82 that is in communication with seat actuator 44, backrest actuator 46, leg rest actuator 48 and lift actuator 50. Controller 82 is further in communication with a right control panel 84*a*, a left control panel 84*b*, an occupant control panel 86, a brake 88, a sensor 90, a safety mechanism 92, an indicator 94, an exit detection system 96, and a memory 100. Controller 82 is constructed of any electrical component, or group of electrical components, that are capable of carrying out the functions described herein. In many embodiments, controller 82 is microprocessor based, although not all such embodiments need include a microprocessor. In general, controller 82 includes any one or more microprocessors, microcontrollers, field programmable gate arrays, systems on a chip, volatile or nonvolatile memory, discrete circuitry, and/or other hardware, software, or firmware that is capable of carrying out the functions described herein, as would be known to one of ordinary skill in the art. Such components can be physically configured in any suitable manner, such as by mounting them to one or more circuit boards, or arranging them in other manners, whether combined into a single unit or distributed across multiple units. The instructions followed by controller 82 in carrying out the functions described herein, as well as the data necessary for carrying out these functions are stored in memory 100.

In one embodiment, controller 82 communicates with individual circuit boards contained within each control panel 84*a*, 84*b*, and 86 using an I-squared-C communications protocol. It will be understood that, in alternative embodiments, controller 82 could use alternative communications protocols for communicating with control panels 84*a*, 84*b*, and/or 86 and/or with the other components of control system 80. Such alternative communications protocols includes, but are not limited to, a Controller Area Network (CAN), a Local Interconnect Network (LIN), Firewire, one or more Ethernet switches, such as disclosed in commonly assigned, copending U.S. patent application Ser. No. 14/622,221 filed Feb. 13, 2015 by inventors Krishna Bhimavarapu et al. and entitled COMMUNICATION METHODS FOR PATIENT HANDLING DEVICES, the complete disclosure of which is incorporated herein by reference. Still other forms of communication are possible.

Sensor 90, brake 88, safety mechanism 92, indicator 94, and exit detection system 96 are described in greater detail in the aforementioned copending U.S. patent application Ser. No. 14/212,253 filed Mar. 14, 2014 and incorporated herein by reference. Accordingly, a detailed description of these components is not provided herein. In general, however, brake 88 is adapted to selectively brake and unbrake wheels 30 (prevent and allow both the swiveling and rotation of wheels 30) so that chair 20 may be moved to different locations. Indicator 94, which may be a light or other device, provides a visual indication to a user of chair 20 when brake 88 is activated. Sensor 90 is adapted to detect when chair 20 is in motion and forward that information to controller 82, which then automatically prevents brake 88 from braking wheels 30 while the chair 20 is in motion. This helps avoid damage to the brake 88 and/or sudden jerks to an occupant of chair 20. Safety mechanism 92 is adapted to detect if an obstruction lies beneath a bottom edge of armrests 28 and prevent movement of armrests 28 when such an obstruction is present. Exit detection system 96 is adapted, when armed, to provide an audio and/or visual alarm when an occupant leaves chair 20.

Figure 5:
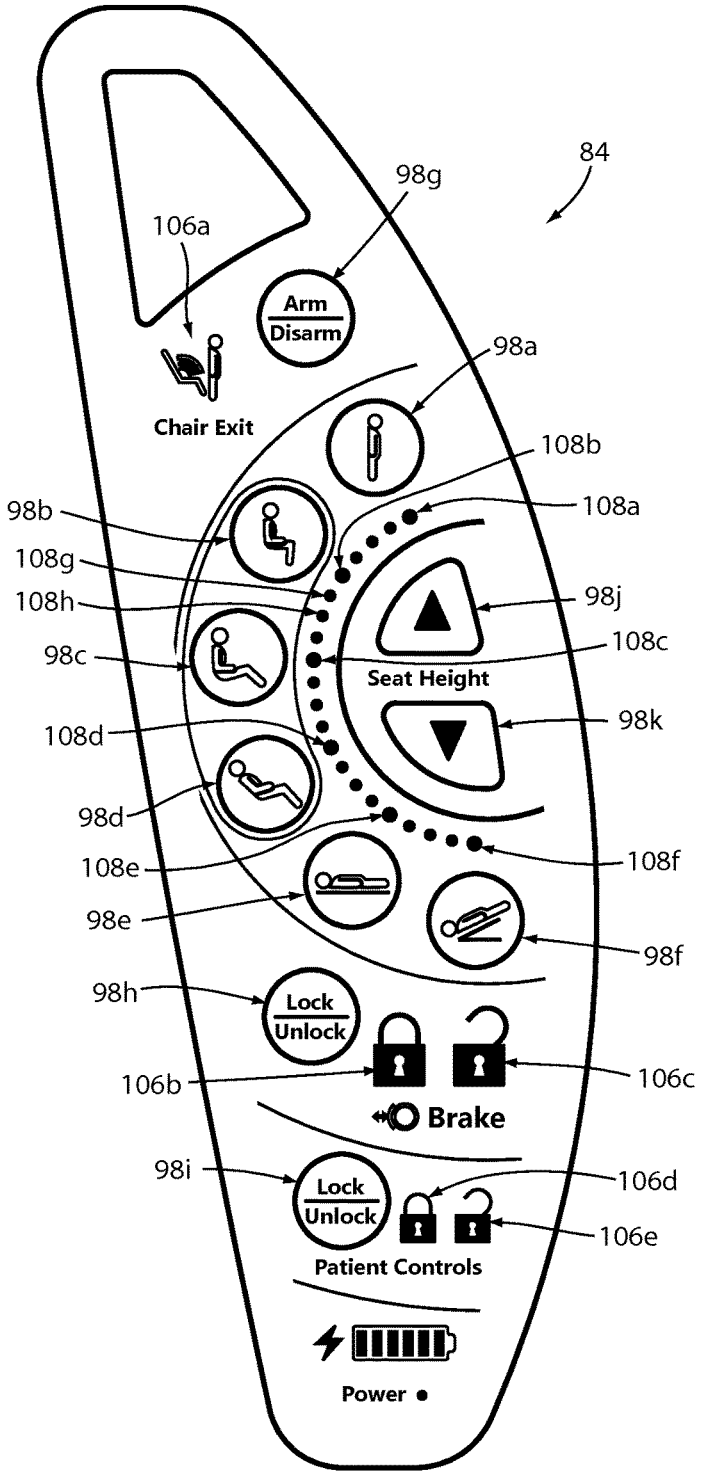
FIG. 5 is a plan view of a control panel of the chair of FIG. 1 showing a full set of controls that are available and active.

One embodiment of a control panel 84 is shown in greater detail in FIG. 5. Because right control panel 84*a* and left control panel 84*b* look the same and provide the same functionality, the following description of control panel 84 will apply to both control panels 84*a* and 84*b*. Control panel 84 includes a plurality of controls 98*a*-98*i*. In the embodiment shown in FIG. 5, each control 98 is a dedicated button that, when pushed, carries out a specific function (described below). In an alternative embodiment, controls 98 may be implemented as one or more areas on a touch screen that is incorporated into control panel 84 such that, when touched, the control 98 carries out the corresponding function. Other configurations are also possible.

In the embodiment shown in FIG. 5, control panel 84 includes a stand state control 98*a*, a first upright state control 98*b*, a second upright state control 98*c*, a recline state control 98*d*, a flat state control 98*e*, a Trendelenburg state control 98*f*, an arm/disarm control 98*g*, a brake control 98*h*, a patient lockout control 98*i*, a lift up control 98*j*, and a lift down control 98*k*. When a user presses on any of state controls 98*a-f*, controller 82 will activate the necessary ones of actuators 44, 46, 48, and/or 50 to move the chair 20 to the corresponding state. That is, stand state control 98*a* will move chair to stand state 42; first upright state control 98*b* will move chair to first upright state 40; second upright state control 98*c* will move chair 20 to second upright state 38; recline state control 98*d* will move chair 20 to recline state 36; flat state control 98*e* will move chair 20 to flat state 34; and Trendelenburg state control 98*f* will move chair 20 to Trendelenburg state 32.

In the embodiment illustrated in FIG. 5, a user must press on one of state controls 98*a-f* and continue to press on the corresponding state control 98*a-f* until the actuators bring chair 20 into the state corresponding to the pressed control. If the user stops pressing on the corresponding control 98 prior to the chair reaching the commanded state, controller 82 will cease movement of all of the actuators and chair 20 will stop in whatever position and orientation (i.e. state) it is currently in. Thus, for example, if a user wishes to change chair 20 to the stand state 42, the user must press and hold stand state control 98*a* until actuators 44, 46, 48, and 50 have finished moving seat 22, backrest 24, and leg rest 26 into the positions and orientations corresponding to stand state 42. In an alternative embodiment, controller 82 may be modified such that pressing on one of state controls 98*a-f* and thereafter releasing the corresponding control will cause controller 82 to move the chair to the commanded state automatically without requiring the user to continue to press the corresponding state control 98*a-f*.

When a user presses arm/disarm control 98*g*, controller 82 toggles between arming and disarming exit detection system 96. As noted, when exit detection system 96 is armed, controller 82 will issue an alert if an occupant leaves chair 20. When disarmed, no such alarm will be issued when the occupant leaves chair 20.

When a user presses brake control 98*h* (FIG. 5), controller 82 will toggle brake 88 on and off. This toggling is carried out electrically by a powered brake actuator (not shown) under the control of controller 82. Chair 20 may further include a plurality of brake pedals 104 (e.g. FIG. 3) that are adapted to manually engage the brake 88 when pressed downwardly and manually disengage the brake 88 when lifted upwardly. This manual engagement and disengagement works in coordination with the electric activation and deactivation of the brake by controller 82 under the control of control panel 84. That is, regardless of what state the brake is currently in (braked or unbraked), pressing on brake control 98*h* will electrically toggle the brakes to the other state, as well as physically move pedal 104 to the other state by moving it either up (brakes disengaged) or down (brakes engaged). Similarly, regardless of what state the brake is currently in, manually moving pedal 104 to its other position (either up or down) will manually change the state of the brakes. Still further, anytime brake control 98*h* is pressed for the first time after the state of the brakes was previously changed manually, controller 82 will automatically change the state of the brakes electrically. A user is therefore completely free to change the state of the brakes manually via pedals 104 or electrically via brake control 98*h* in any order or sequence.

When a user presses patient lockout control 98*i*, controller 82 toggles between enabling and disabling occupant control panel 86. When occupant control panel 86 is disabled, pressing on any of the controls thereon (e.g. buttons, knobs, switches, or the like) does not cause chair 20 to do anything. When occupant control panel 86 is enabled, pressing on any of the controls thereon will cause chair 20 to carry out the corresponding function of the control that has been pressed. In some embodiments, occupant control panel includes a smaller subset of controls than that shown on control panel 84 of FIG. 5. For example, in one embodiment, occupant control panel 86 includes upright state control 98*b*, second upright state control 98*c*, and recline state control 98*d*, but does not include any of the other controls 98*a*, 98*e*, 98*f*, 98*g*, 98*h*, or 98*i*.

When a user presses on lift up control 98*j*, controller 82 will cause lift actuator 50 to extend such that the height of seat 22 is raised. When a user presses on lift down control 98*k*, controller 82 will cause lift actuator 50 to retract such that the height of seat 22 is lowered. This lifting or lowering of seat 22 via controls 98*j* and 98*k* will continue for as long as controls 98*j* or 98*k* are pressed, or until seat 22 reaches its upper or lower limits.

Control panel 84 further includes an exit icon 106*a* that is illuminated in a first manner when exit detection system 96 is armed and that is illuminated in a second and different manner when exit detection system 96 is disarmed. The difference between the first and second manners of illumination may take on a variety of different forms. In one embodiment, the first manner of illumination is brighter than the second manner. In another embodiment, the first manner of illumination is a different color than the second manner. In general, the second manner of illumination provides just enough illumination for a user to be able to see icon 106*a*, but not so much so as to cause the user to believe that exit detection system 96 is armed. In contrast, the first manner of illumination provides illumination of a greater intensity and/or different color such that a user knows that exit detection system 96 is armed.

Control panel 84 also includes a brake enabled icon 106*b*, a brake disabled icon 106*c*, a patient control lockout enabled icon 106*d*, and a patient control lockout disabled icon 106*e*. Brake enabled icon 106*b* is illuminated when brake 88 is activated (either manually or electrically) and is not illuminated when brake 88 is deactivated. Brake disabled icon 106*c* is illuminated when brake 88 is deactivated (either manually or electrically), and is not illuminated when brake 88 is activated. Patient control lockout enabled icon 106*d* is illuminated when occupant control panel 86 is enabled, and is not illuminated when occupant control panel 86 is disabled. Patient control lockout disabled icon 106*e* is illuminated when occupant control panel 86 is disabled, and is not illuminated when occupant control panel 86 is enabled.

In an alternative embodiment, all of icons 106*b*, 106*c*, 106*d*, and 106*e* remain illuminated regardless of the brake and patient lockout status, but simply change their manners of illumination based on the status of these two features. That is, similar to icon 106*a*, each of icons 106*b-e* have at least two different manners of illumination, and controller 82 switches between these two based upon the brake status and the status of the occupant control panel 86 (enabled or disabled). In this manner, a user is always able to see all of icons 106*b-e* and is made aware of the status of corresponding to these icons by the differences in illumination between icons 106*b* and 106*c*, and the differences in illumination between icons 106*d* and 106*e*. Still other variations are possible.

Control panel 84 further includes a plurality of progress indicators 108 that are arranged in a curved line on control panel 84 (FIG. 5). In the embodiment shown in FIG. 5, progress indicators 108 are light emitting diodes (LEDs). In alternative embodiments, progress indicators 108 may include one or more graphics on a display that change based on the movement of chair 20 through the states. Still other forms of indicators 108 are possible. Regardless of form, indicators 108 provide a visual indication to a user of the current state of chair 20. That is, controller 82 changes which one of indicators 108 is illuminated based on the current state of chair 20. For example, indicators 108 include indicators 108*a*, 108*b*, 108*c*, 108*d*, 108*e*, and 108*f* that correspond to states 32, 34, 36, 38, 40, and 42, respectively. Whenever chair 20 is in one of these states (32-42), controller 82 will illuminate the indicator 108*a-f* that corresponds to that state. Further, as chair 20 moves between any of states 42, 40, 38, 36, 34, and/or 32, controller 82 will illuminate corresponding ones of indicators 108 that are in between indicators 108*a-f*, thereby providing a user a visual indication of how far or near the chair's current state is from one of the six states 32, 34, 36, 38, 40, and 43.

For example, if chair 20 is currently in first upright state 40, indicator 108*b*—which is the indicator 108 that is closest to first upright state control 98*b* on control panel 84—will be illuminated. All of the other indicators 108 will be unilluminated. If a user then presses, say, flat state control 98*e* in order to move chair 20 to flat state 34, controller 82 will selectively turn on and turn off the indicators 108 as the chair progresses from first upright state 40 to flat state 34. In other words, shortly after flat state control 98*e* is pressed and chair 20 has begun to move toward flat state 34, controller 82 will turn off indicator 108*b* and turn on indicator 108*g*. After chair 20 has moved an even greater amount toward flat state 34, controller 82 will turn off indicator 108*g* and turn on indicator 108*h*. This pattern of turning on and off indicators 108 will continue as chair 20 progresses toward flat state 34 such that when chair 20 finally reaches flat state 34, indicator 108*e* will be illuminated, while none of the other indicators 108 will be illuminated. Controller 82 will therefore control the illumination of indicators 108 in a manner that provides a visual indication of what state chair 20 is currently in vis-a-vis the six states 32, 34, 36, 38, 40, and 42.

In the example above where chair 20 initially starts in first upright state 40 and is moved to flat state 34, chair 20 will pass through second upright state 38 and recline state 36 before eventually reaching flat state 34. This is because all of the six states 32, 34, 36, 38, 40, and 42 are arranged sequentially and controller 82 is configured to coordinate the control of actuators 44, 46, 48, and 50 such that chair 20 is only able to move from one state to another in the sequence defined on control panel 84. That is, a user cannot move chair 20 from state 32 to state 42 without passing through states 34, 36, 38, and 40, and vice versa. Similarly, regardless of chair 20's initial state, it will always move sequentially from its initial state to its final commanded state by moving through whatever intermediate states, if any, that lie between the initial and final states. In one embodiment, the movement of chair 20 through these intermediate states, if any, happens without pause or interruption. That is, controller 82 continues to move the appropriate actuators without stopping as the chair passes through any intermediate states.

However, in at least one embodiment, controller 82 is configured to pause for a brief moment whenever chair 20 passes through one of states 34, 36, 38, or 40 while on its way to another state. Such pausing may also be accompanied by an aural indication to the user. The pausing and/or aural indication provides notification to the user that the chair has reached one of these intermediate states. Movement toward the final desired state will resume automatically after this short pause (so long as the user continues to press on the state control 98 that corresponds to the final desired state).

Controller 82 is further configured to automatically remove and/or disable one or more of the controls 98 on control panel 84 based upon the current state of chair 20. That is, when chair 20 is in some states, it may be undesirable to allow a user to access certain functionality of chair 20. Controller 82 will therefore disable and/or remove the controls 98 from control panel 84 corresponding to those functions when chair 20 is in the particular states for which such functions are not desired. For example, in one embodiment, controller 82 is configured to disable the exit detection system 96 whenever the chair is in the stand state 42, flat state 34, or Trendelenburg state 32. Accordingly, in one embodiment, whenever chair 20 is in one of these three states, controller 82 will both disable and cease to illuminate arm/disarm control 98*g*.

Figure 5A:
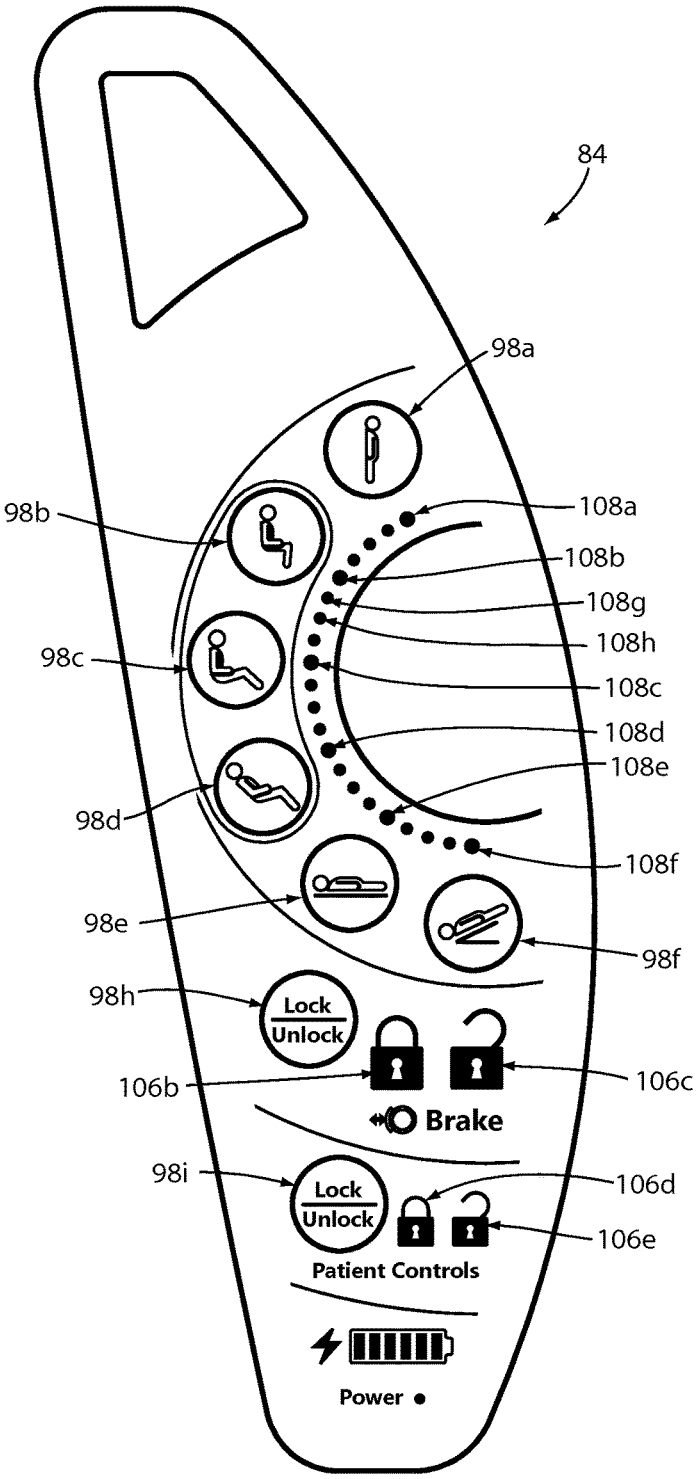
FIG. 5A is a plan view of the control panel of FIG. 5 showing a reduced set of controls that are available and active.

An example of this disabling and terminated illumination is shown in FIG. 5A where it can be seen that control 98*g* is no longer visible. Indeed, controller 82 has also ceased to provide any back illumination to the chair exit icon 106*a*, thereby rendering it virtually invisible to a user. Were a user to press on control panel 84 in the area of arm/disarm control 98*g* while it was in the unilluminated state of FIG. 5A, controller 82 would take no action in response. That is, turning on the exit detection system 96 while the chair is in any one of the stand state 42, flat state 34, or Trendelenburg state 32 is not possible. By removing the back illumination for arm/disarm control 98*g* and chair exit icon 106*a*, a user will know that this function is disabled. This helps avoid the possibility—which could happen if control 98*g* and/or icon 106*a* were to remain illuminated in any of these states—of the user attempting to turn on the exit detection and becoming frustrated that this functionality appeared to be broken in these states, when in fact this functionality had been deliberately disabled in these states.

Another example of the automatic disabling of a function and the visual removal of its corresponding control 98 from control panel 84 is the lift up and lift down controls 98*j* and 98*k*, respectively. In one embodiment, chair 20 is configured such that the height of chair 20 cannot be changed by controls 98*j* and 98*k* when chair 20 is in certain states. Specifically, in one embodiment, controller 82 disables controls 98*j* and 98*k*, as well as turns off the illumination of these controls on control panel 84, whenever chair 20 is in the Trendelenburg state 32 or the stand state 42. FIG. 5A illustrates how control panel 84 appears when chair 20 is in either of these states. As can be seen in FIG. 5A, lift up and lift down controls 98*j* and 98*k* have disappeared from view on control panel 84. This is accomplished by controller 82 ceasing to provide back illumination for these controls. In addition to removing this back illumination, controller 82 has also disabled these controls such that, were a user to press on the areas of control panel 84 where controls 98*j* and 98*k* otherwise appear, controller 82 will take no action. Thus, whenever chair 20 is in the Trendelenburg state 32 or stand state 42, a user cannot adjust the height of chair 20 via controls 98*j* and 98*k*.

It will be understood that, in other embodiments, different ones of controls 98 may be automatically disabled than the ones described above when chair 20 is in one or more specific states. Further, the specific states in which exit detection system 96 and lift controls 98*j* and 98*k* are disabled may be varied from the states described above. Still other variations are possible.

Control panel 84 shown in FIGS. 5 and 5A is constructed, in one embodiment, in the same manner as the control panel described in commonly assigned, copending application Ser. No. 14/282,383 filed May 20, 2014 by applicants Christopher Hopper et al. and entitled THERMAL CONTROL SYSTEM, the complete disclosure of which is incorporated herein by reference. When constructed in this manner, the background of control panel 84 is generally black and when controller 82 ceases to provide back illumination to any one of controls 98 (e.g. 98, 98*j*, and/or 98*k*) or icons 106 (e.g. 106*a*), the lack of back illumination causes the area of the control 98 or icon 106 to appear black, thereby blending in with the adjacent black background of the control panel and making the control 98 or icon 106 virtually, if not completely, invisible.

In other embodiments, control panel 84 may be physically constructed to include, or to be made entirely of, a liquid crystal display, or other type of display that is capable of selectively displaying one or more graphics thereon. When constructed in this manner, the display is preferably incorporated into a touch screen configuration such that pressing on different areas of the screen will cause controller 82 to react accordingly. When control panel 84 is constructed in this manner, controller 82 disables a selected function in certain states by simply ceasing to display the graphic corresponding to that function and ignoring any pressing by the user on the area of the touch screen that is otherwise aligned with the graphic for that function.

FIGS. 6, 7, 8, 9, 10, and 11 illustrate in greater detail chair 20 in each of the states 32, 34, 36, 38, 40, and 42, respectively. As with FIG. 2, one of the armrests 28 has been removed in order to provide a clear view of the interior of chair 20 and its internal structure in each of these states.

Figure 12:
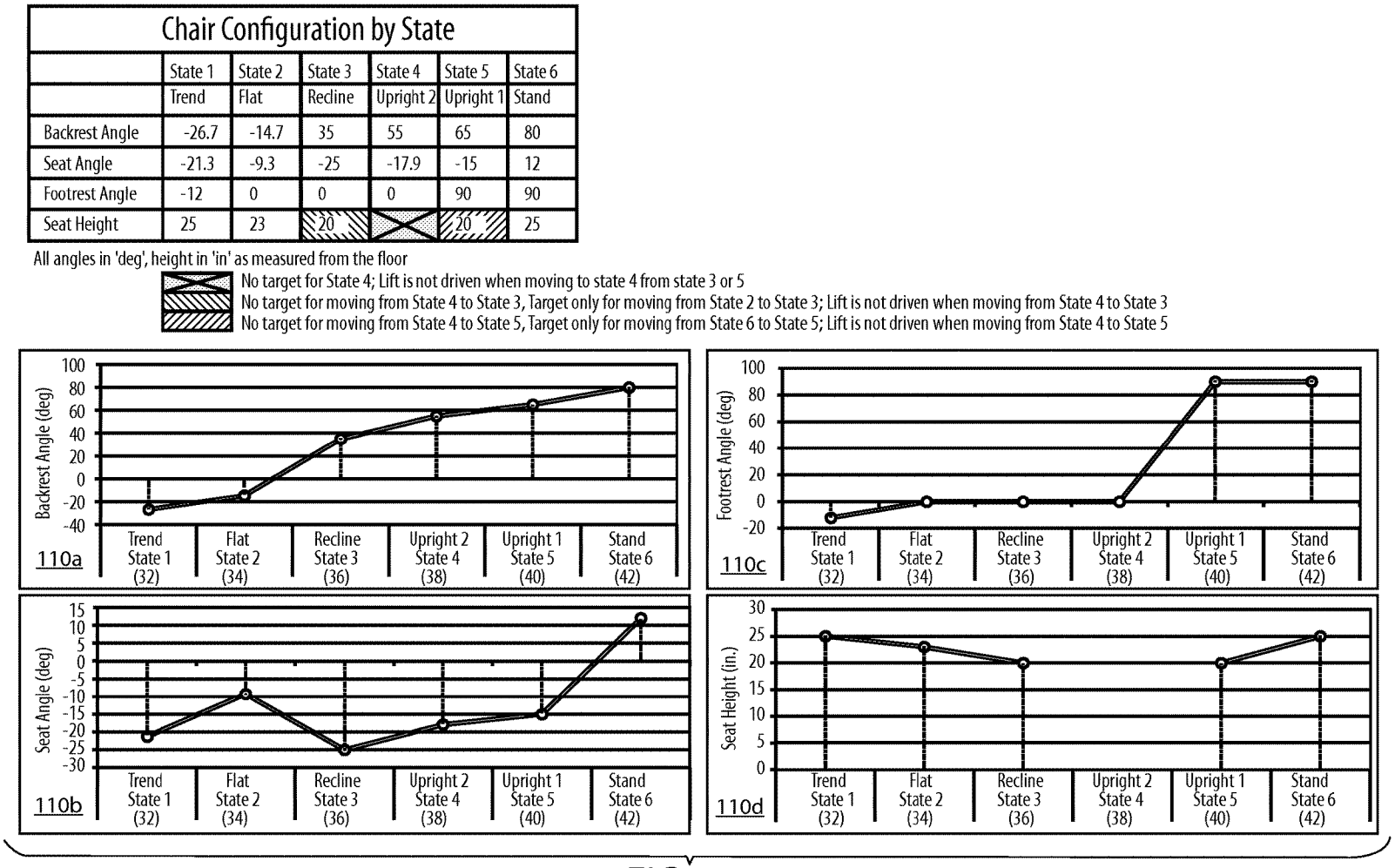
FIG. 12 is a set of diagrams illustrating the backrest angles, seat angles, footrest angles, and seat heights of the chair when the chair moves between the states illustrated in FIGS. 6-11.

FIG. 12 shows four charts 110 that graph the seat 22 angles, the backrest 24 angles, the leg rest 26 angles, and the seat 22 height in each of the six different states 32, 34, 36, 38, 40, and 42. More specifically, chart 110*a* shows the angles of backrest 24 (with respect to horizontal) for each of the six states 32-42, as well as the angles of backrest 24 between each of these six states 32-42. Chart 110*b* shows the angles of seat 22 (with respect to horizontal) for each of the six states 32-42, as well as the angles of seat 22 between each of these six states. Chart 110*c* shows the angles of leg rest 26 (with respect to horizontal) for each of the six states 32-42, as well as the angles of leg rest 26 between each of these six states 32-42. Finally, chart 110*d* shows the height in inches (measured from the floor on which chair 20 is positioned) of seat 22 for each of the six states 32-42, as well as the height of seat 22 between each of these six states.

FIG. 13 shows four charts 112 that graph the position of the four actuators 44, 46, 48, and 50 in each of the six states 32-42, as well as in between each of these states. More specifically, chart 112*a* shows the position of backrest actuator 46 in each of the six states 32-42, as well as its position in between these states. Chart 112*b* shows the position of seat actuator 44 in each of the six states 32-42, as well as its position in between these states. Chart 112*c* shows the position of leg rest actuator 48 in each of the six states 32-43, as well as its position in between these states. And chart 112*d* shows the position of lift actuator 50 in each of the six states 32-42, as well as its position in between these states.

With specific reference to lift actuator 50 and its height and position information shown in charts 110*d* and 112*d*, respectively, it can be seen that no height or position information is shown between recline state 36 and first upright state 40. This is because lift actuator 50 does not have a controlled height or position in the second upright state 38. That is, controller 82 does not power lift actuator 50 when moving from first upright state 40 to second upright state 38, nor does controller 82 power lift actuator 50 when moving from recline state 36 to second upright state 38. Instead, whatever position lift actuator 50 is currently in when chair 20 starts out from either first upright state 40 or recline state 36, controller 82 leaves it in that position when moving to second upright state 38.

Figure 14:
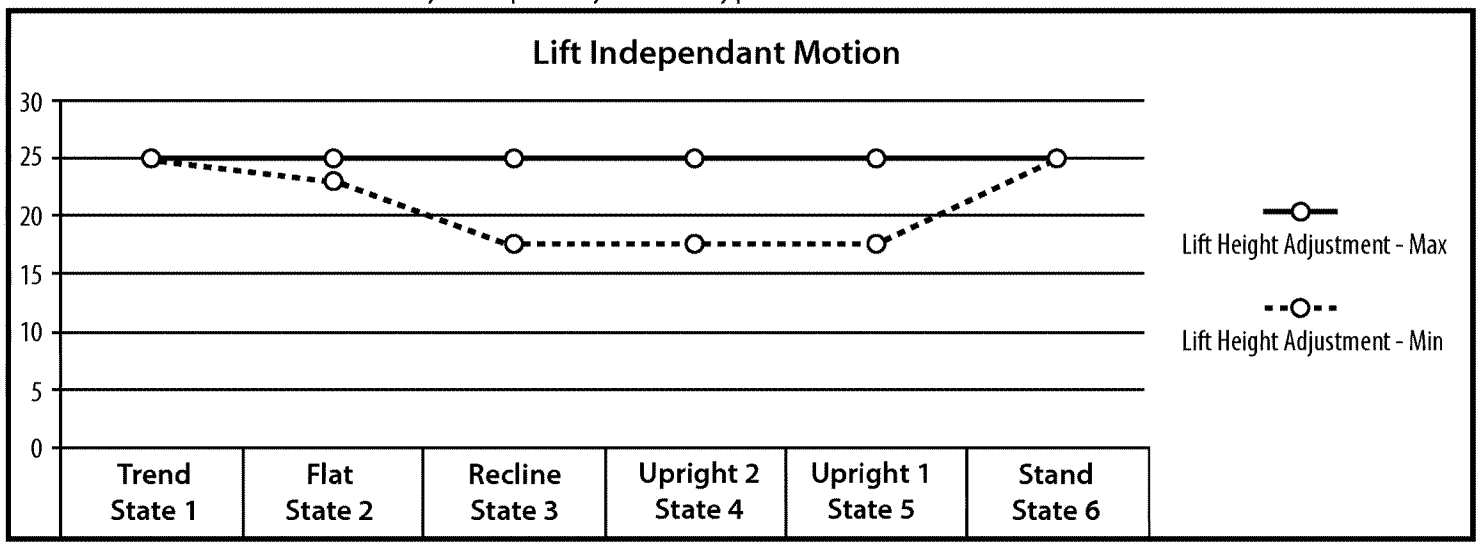
FIG. 14 is a chart illustrating a range of permitted seat height adjustments when the chair moves between the states illustrated in FIGS. 6-11.

As can been seen from FIG. 14, lift actuator 50 is also independently movable by a user between the limits shown in the graph of FIG. 14 whenever chair 20 is in the flat, recline, second upright, or first upright states 34, 36, 38, and 40, respectively. For example, as shown in FIG. 14, when chair 20 is in the recline state 36, a user is free to change the height of seat 22 (by pressing on controls 98*j*, 98*k*, or the height controls on occupant control panel 86) to any height that is within the range of about 17.5 inches to 25 inches above the floor. Although a user is free to adjust the height of seat 22 within the ranges shown in FIG. 14, controller 82 will control lift actuator 50 so that it attempts to reach the target heights for the Trendelenburg state 32, the flat state 34, and the stand state 42 shown in chart 110*d* (FIG. 12) whenever chair 20 is moved to any of these states. Further, controller 82 will control lift actuator 50 so that it attempts to reach the target height for the recline state 36 shown in chart 110*d* when chair 20 starts from any state to the left of recline state 36 in chart 110*d*. Finally, controller 82 will control lift actuator 50 so that it attempts to reach the target height for first upright state 40 shown in chart 110*d* when chair 20 starts from any state to the right of first upright state 40 in chart 110*d*.

Each actuator 44, 46, 48, and 50 includes an internal position sensor that sends a signal to controller 82 that is indicative of its current position. Controller 82 uses these position signals as feedback signals in the control of actuators 44, 46, 48, and 50. That is, controller 82 controls each of actuators 44, 46, 48, and 50 in a closed-loop manner based upon the position feedback signals coming from actuators 44, 46, 48, and 50.

Controller 82 uses one of the pre-defined positions of states 32, 34, 36, 38, 40, and 42 as the target values for controlling actuators 44, 46, 48, and 50. More specifically, chair 20 has stored in memory 100 the desired positions of each of actuators 44-50 for each of the six states 32-42. Whenever chair 20 is commanded by a user to move from its current position to a different one of these six states, controller 82 will use the stored position information for whichever one of states 32-42 is the next state in the sequence of states that leads to the final desired state as the target positions in the closed-loop control of each of the actuators 44-50.

For example, if chair 20 is initially in flat state 34 and a user presses on stand state control 98*a*, controller 82 will first retrieve from memory 100 the positions of each actuator 44-50 that correspond to recline state 36. Controller 82 chooses the positions of recline state 36 because recline state 36 is the first one of the six states in the sequence of states between flat state 34 (chair 20's initial state) and stand state 42 (chair 20's final desired state in this example). Once the positions of each actuator 44-50 for recline state 36 are retrieved, controller 82 uses these positions as the target positions for moving each of the actuators 44-50. Thus, with specific reference to backrest actuator 46, controller 82 selects a position of approximately 15 inches as its target position (see chart 112*a* of FIG. 13 and the value of backrest actuator 46 for the recline state 36). Controller 82 then controls backrest actuator 46 so that it extends from the approximately 12.5 inches of its current initial position (flat state 34) to the 15 inches corresponding to recline state 36. Controller 82 does the same for each of the other actuators using the positions shown in charts 112*a*, 112*c*, and 112*d* of FIG. 13.

As will be described in more detail below, controller 82 controls each of actuators 44-50 such that they all arrive at recline state 36 simultaneously, or substantially simultaneously. After each of the actuators 44-50 reaches recline state 36, controller 82 then retrieves the position values for each of the actuators 44-50 that correspond to the next one of the six states in the sequence of movement. Thus, in this example, where the final desired state is stand state 42, controller 82 then retrieves the position values for second upright state 38. Once these are retrieved, controller 82 controls each of the actuators 44-50 such that they simultaneously arrive at each of their positions that correspond to second upright state 38. Thereafter, controller 82 proceeds in a similar manner and moves each of the actuators 44-50 toward their positions that correspond to first upright state 40. Finally, after the actuators have arrived at their positions for first upright state 40, controller 82 retrieves from memory 100 the values corresponding to stand state 42 and moves the actuators to these values. This movement, as with all movement to one of the six states 32-42, is coordinated by controller 82 such that all of the actuators stop at the desired state (stand state 42 in this example) simultaneously, or substantially simultaneously. The phrase "substantially simultaneously" refers to arrivals that are not precisely simultaneously, but are not otherwise readily discernable by a user as occurring at separate times.

Because controller 82 moves actuators 44-50 toward the positions corresponding to each of the six states 32-42, controller 82 does not store in memory the positions identified in FIG. 13 that are between these six states. Thus, for example, controller 82 does not store point A in chart 112*a* of FIG. 13 and does not ever utilize point A as a target value for backrest actuator 46. This can be better understood by way of an example. Suppose, for instance, that chair 20 initially starts in a position where backrest actuator 46 has the value defined by point B. Suppose further that a user presses on flat state control 98*e*. Controller 82 will not, in that case, attempt to control backrest actuator 46 such that it follows a path from point B to point A, and then from point A to point C (FIG. 13). Instead, controller 82 will control backrest actuator 46 such that it follows a path directly from point B to point C (where point C corresponds to flat state 34). Similarly, if backrest actuator 46 starts out at point B and a user presses recline state control 98*d*, controller 82 will control actuator 46 such that it follows a path directly from point B to point D (the point corresponding to the recline state), rather than a path from point B to point A, and then from point A to point D. Thus, not only for backrest actuator 46, but for all of the actuators 44-50, controller 82 moves them such that they are directed toward whatever one of the six states is next in the sequence of states between their initial position and their final user-chosen position.

As was noted earlier, controller 82 controls each of the actuators 44-50 such that they all arrive simultaneously at each of the six states 32-42 on their journey from their current initial position to their final user-chosen position (with the sole exception of the lift actuator which, as noted, does not have a target position and is therefore not moved for certain states, such as the second upright state 38). Thus, for example, if chair 20 is initially in Trend state 32 and a user presses on stand state control 98*a*, controller 82 will moves each of the actuators 44-50 in a manner such that they all simultaneously (or substantially simultaneously) arrive first at flat state 34. Controller 82 will then continue to move actuators 44-50 such that they all simultaneously arrive at recline state 36. Controller 82 will continue in this manner to move actuators 44-50 such that they all arrive simultaneously at second upright state 38 (except for lift actuator 50 which does not change position between recline state 36 and second upright state 38), and then all arrive simultaneously at first upright state 40 (with the exception again of lift actuator 50), and then all arrive simultaneously at stand state 42.

In one embodiment, the manner in which controller 82 achieves this simultaneous arrival is accomplished as follows. Whenever a user presses on a state control 98*a-g*, controller 82 identifies which one of the six states 32-42 is the first one that chair 20 will proceed to on its journey to the user-chosen final state. Once that first state is identified, controller 82 compares the current position of each of the actuators 44-50 with the desired positions for each of the actuators corresponding to that first state. Controller 82 then identifies as a pacing actuator whichever one of the actuators 44-50 has the greatest difference between its current position and its desired position at the first state. Controller 82 then determines the ratio of the distances the other actuators (the non-pacing actuators) have to travel to the first state compared to the distance that the pacing actuator has to travel to this first state. Thus, for example, if backrest actuator 46 is the pacing actuator and it has to move 120 units to the first state and seat actuator 44 has to move thirty units to the first state, controller 82 will calculate a ratio of 0.25 (30/120=0.25). Controller 82 will do a similar ratio calculation for the other two non-pacing actuators (leg rest and lift, in this example).

Once all of the ratios are determined, controller 82 controls the pacing actuator such that it moves at a first speed, and controls the other non-pacing actuators to move at speeds that are equal to the first speed multiplied by the calculated ratios. Thus, in the example above, controller 82 sends control signals to the seat actuator 44 to move at a speed equal to one fourth of the commanded speed of the pacing actuator. Further, as noted above, controller 82 uses feedback during the movement of the actuators 44-50. Consequently, controller 82 will repetitively re-calculate the distances of each of the actuators from their desired first state positions, re-calculate the ratios, and send out revised speed commands, if necessary, to ensure that the actuators arrive at the first state substantially simultaneously.

Once the actuators arrive at the first state, controller 82 will repeat the same procedure for moving chair 20 to the second state (assuming that the first state is not the user-chosen final state). In repeating this procedure, controller 82 may or may not choose the same actuator as the pacing actuator that is chosen for movement to the first state. The selection of the pacing actuator for movement to the second state is based on the actuator having the greatest distance to travel from the first state to the second state, which may or may not be the same actuator that had the greatest distance to travel from the initial state to the first state. Once the pacing actuator is chosen for movement to the second state, the distance ratios for the other actuators are computed and used for generating speed commands.

In some cases, due to the feedback received by controller 82 from each of the actuators 44-50, the selection of which of the four actuators 44-50 is the pacing actuator for movement to the next state may change before chair 20 arrives at that next state. This can happen, for example, if one of the non-pacing actuators ends up moving slower than commanded (due to, for example, excessive loading) such that its distance to the next state ends up surpassing the pacing actuator's distance to the next state at some point during the movement to that next state.

Figure 15:
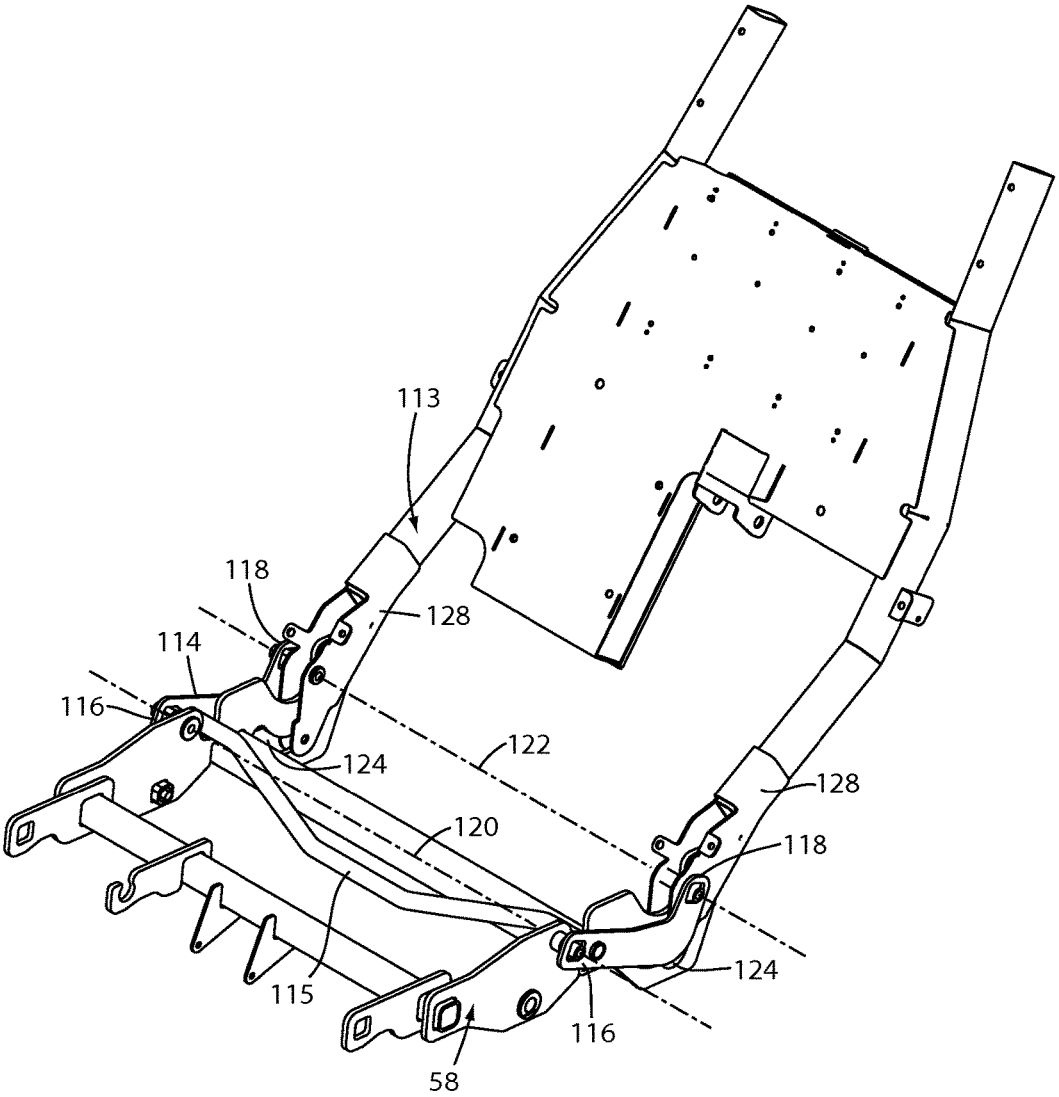
FIG. 15 is a perspective view of an alternative embodiment of a backrest that may be incorporated into the chair of FIG. 1.

FIG. 15 illustrates one manner in which backrest 24 may be joined to seat 22. More specifically, FIG. 15 illustrates one embodiment of a backrest frame 113 pivotally coupled to seat frame 58. Seat frame 58 is pivotally coupled to backrest frame 113 by a pair of links 114 that are joined to each other by way of a crossbar 115. Crossbar 115 helps with stabilizing the pivotal connection of backrest frame 113 to seat frame 58. Each link 114 has a first end 116 that is pivotally coupled to seat frame 58 and a second end 118 that is pivotally coupled to backrest frame 113. The pivotal coupling at first end 116 defines a first pivot axis 120 and the pivotal coupling at second ends 118 defines a second pivot axis 122. As will be discussed in greater detail below, seat frame 58 pivots about axes 120 and 122 (sometimes simultaneously and sometimes individually) as backrest 24 pivots with respect to respect to seat 22.

Figure 16:
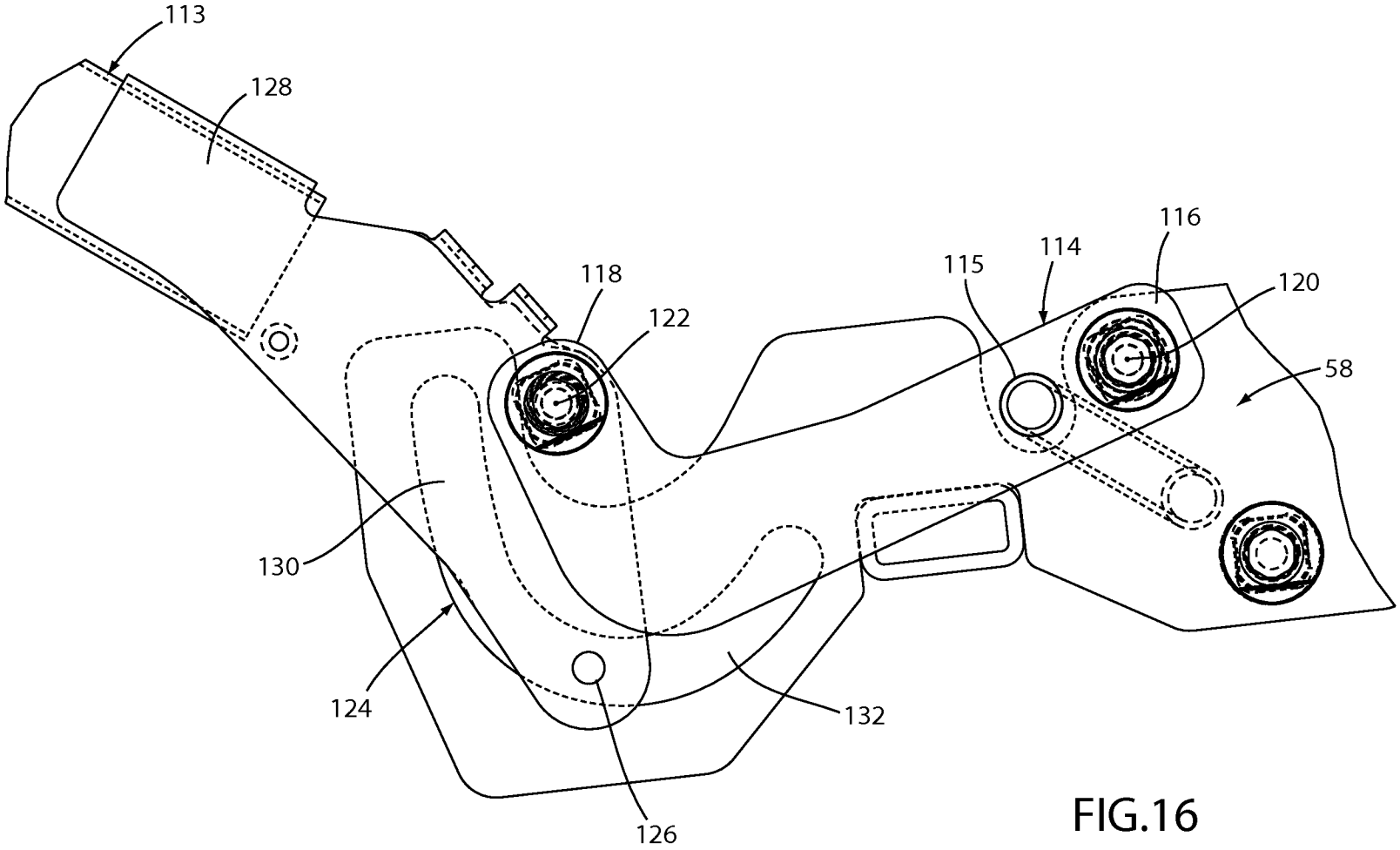
FIG. 16 is a side elevational view of a linkage between the backrest and seat frame of FIG. 15.

Seat frame 58 further includes a pair of channels 124 defined in it that are positioned adjacent a rear end of either side of seat frame 58. A roller 126 that is rollingly mounted to a backrest bracket 128 rides in each of channels 124 as backrest frame 113 pivots with respect to seat frame 58 (FIG. 16). The shape of channel 124 guides the movement of each roller 126 during pivoting of backrest frame 113 with respect to seat frame 58, which in turn determines when and to what extent backrest frame 113 pivots about first pivot axis 120 relative to second pivot axis 122, as will be discussed below in greater detail with respect to FIG. 16.

As shown in FIG. 16, channel 124 includes a generally upright upper portion 130 and a generally arcuate lower portion 132. When roller 126 is in the generally upright upper portion 130, the sides of channel 124 constrain roller 126 from left-to-right movement (as viewed in FIG. 16). This constraining of roller 126 against left-to-right movement in FIG. 16 while positioned in upper portion 130 prevents backrest frame 113 from pivoting about second pivot axis 122. However, when roller 126 is positioned in the generally upright upper portion 130 of channel 124, it is free to move in a generally up and down direction. This vertical freedom of movement permits backrest frame 113 to pivot with respect to seat frame 58 about first pivot axis 120.

As backrest frame 113 tilts backwardly from an initially upright position toward a more reclined position, roller 126 moves from upper portion 130 toward lower portion 132. As roller 126 moves closer to lower portion 132, the side-to-side movement constraints (as viewed in FIG. 16) on roller 126 in channel 124 become more relaxed, thereby permitting backrest frame 113 to start pivoting more and more about second pivot axis 122. When roller 126 eventually reaches lower portion 132, backrest frame 113 will pivot exclusively about second pivot axis 122 and cease to pivot about first pivot axis 120. This exclusive pivoting about second pivot axis 122 is due to the shape of lower portion 132, which has a curve that is coaxial with respect to second pivot axis 122 (as viewed in FIG. 16).

In summary, when reclining backrest frame 113 from an initially upright position to a fully reclined position, backrest frame 113 initially pivots backward about first pivot axis 120 for a first angular range, then begins to pivot simultaneously about both first and second pivot axes 120 and 122 for a second angular range, and finally pivots exclusively about second pivot axis 122 for a third angular range. The relative amount of pivoting of backrest frame 113 about each of axes 120 and 122 during the second angular range is not static, but changes as the backrest pivots. This change in the location of the pivot axis/axes when backrest frame 113 pivots with respect to seat frame 58 helps to reduce the shear forces that are created between chair 20 and the back and buttocks of an occupant of chair 20 as backrest frame 113 pivots. This, in turn, alleviates the discomfort experienced by a patient during pivoting of backrest 24 and/or the need of a patient to re-position himself or herself on chair 20 during pivoting of backrest 24.

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A person support apparatus comprising:

a base;

a seat supported on the base;

a backrest pivotable to different angular orientations with respect to the base;

a leg rest extendible and retractable to different positions with respect to the seat;

a controller for moving the person support apparatus from a first state to a second state, the first state being defined by a first orientation of the backrest and a first position of the leg rest, and the second state being defined by a second orientation of the backrest and a second position of the leg rest;

a control panel in communication with the controller;

a first control on the control panel having a first icon at or near the first control, the first control causing, when pressed, the controller to move the person support apparatus to the first state;

a second control on the control panel having a second icon at or near the second control, the second control causing, when pressed, the controller to move the person support apparatus to the second state; and at least three discrete lights arranged in a line on the control panel, a first one of the lights operably associated with the first state and positioned adjacent the first control; a second one of the lights operably associated with the second state and positioned adjacent the second control; and a third one of the lights positioned between the first and second lights;

wherein the controller illuminates the first light when the person support apparatus is in the first state, illuminates the second light when the person support apparatus is in the second state, and illuminates the third light when the person support apparatus is in an intermediate state between the first and second states.

2. The person support apparatus of claim 1 wherein the controller is further configured to move the person support apparatus from the second state to a third state, and from the third state to a fourth state, and from the fourth state to a fifth state; wherein the third, fourth, and fifth states are each defined by third, fourth, and fifth orientations of the backrest and third, fourth, and fifth positions of the leg rest, respectively; and wherein the control panel includes a plurality of additional lights configured to provide visual indications to a user of how far the person support apparatus has progressed from any of the first, second, third, fourth, or fifth states to any other of the first, second, third, fourth, or fifth states.

3. The person support apparatus of claim 1 wherein the control panel further comprises:

a plurality of intermediate lights positioned between the first and second lights; and wherein the control panel illuminates one of the intermediate lights or the third light when the person support apparatus is transitioning from the first state to the second state.

4. The person support apparatus of claim 1 wherein the first orientation of the backrest is generally upright and the first position of the leg rest is retracted, and the second orientation of the backrest is generally horizontal and the second position of the leg rest is extended.

5. The person support apparatus of claim 1 wherein the first state is further defined by a first orientation and first height of the seat and the second state is further defined by a second orientation and second height of the seat.

6. The person support apparatus of claim 5 wherein the first orientation of the backrest is generally upright, the first position of the leg rest is retracted, the first orientation of the seat is defined by a forward end of the seat being lower than a rear end of the seat, and the first height of the seat is raised; and the second orientation of the backrest is generally horizontal, the second position of the leg rest is extended, the second orientation of the seat is generally horizontal, and the second height of the seat is lowered.

7. The person support apparatus of claim 5 wherein the first state corresponds to a configuration adapted to assist an occupant into a standing position, and the second state corresponds to a configuration adapted to support the occupant in a Trendelenburg position.

8. The person support apparatus of claim 1 further comprising:

a third control on the control panel configured to cause, when pressed, the controller to move the person support apparatus to a third state; and a fourth control on the control panel configured to cause, when pressed, the controller to move the person support apparatus to a fourth state;

wherein the controller is further configured to move the person support apparatus from the first state to the fourth state only by moving the person support apparatus through the second and third states.

9. The person support apparatus of claim 8 wherein the control panel further comprises fifth and sixth controls, the controller is further configured to move the person support apparatus to a fifth state when the fifth control is pressed and to move the person support apparatus to a sixth state when the sixth control is pressed, and wherein the controller moves the person support apparatus from the first state to the sixth state only by moving the person support apparatus through the second, third, fourth, and fifth states.

10. The person support apparatus of claim 8 further comprising a plurality of additional lights configured to provide a visual indication of how far the person support apparatus has progressed when moving from the second state to the fourth state.

11. The person support apparatus of claim 10 wherein a first set of the plurality of additional lights provides a visual indication of how far the person support apparatus has progressed when moving from the second state to the third state, and a second set of the plurality of additional lights provides a visual indication of how far the person support apparatus has progressed when moving from the third state to the fourth state.

12. The person support apparatus of claim 8 wherein the first state is defined by the following: (1) the backrest is pivoted to a non-vertical angular orientation, (2) the leg rest is extended, and (3) a forward end of the seat is higher than a rearward end of the seat; and the fourth state is defined by the following: (1) the backrest is substantially vertical, (2) the leg rest is retracted, and (3) the forward end of the seat is lower than the rearward end of the seat.

13. The person support apparatus of claim 10 wherein the line is a curved line, the at least three lights and the plurality of additional lights are arranged in the curved line and the first, second, third, and fourth controls are positioned sequentially along the curved line.

14. The person support apparatus of claim 10 wherein the control panel further comprises a fifth control and the controller is configured to change a height of the seat only if the fifth control is pressed while the person support apparatus is in a state other than the first state.

15. The person support apparatus of claim 14 further comprising an icon operably associated with the fifth control that is illuminated when the person support apparatus is in the second state and unilluminated when the person support apparatus is in the first state.

16. The person support apparatus of claim 15 wherein the icon is substantially invisible when the person support apparatus is in the first state.

17. The person support apparatus of claim 1 wherein the control panel is positioned along a side of the backrest and adjacent an upper end of the backrest.

18. The person support apparatus of claim 8 wherein the controller moves the person support apparatus between the first, second, third, and fourth states by controlling at least four electrical actuators.

19. The person support apparatus of claim 8 wherein the first state is a Trendelenburg position; the second state is a flat position in which the backrest, seat, and leg rest are oriented generally horizontally; the third state is a reclining position in which the backrest is non-vertical and non-horizontal and the leg rest is extended; and the fourth state is a standing assist position in which the leg rest is retracted, the backrest is substantially vertical, and the seat has a rear end positioned higher than a front end.

20. The person support apparatus of claim 8 wherein the control panel further comprises a fifth control and the controller is configured to change a height of the seat within a range of heights when the fifth control is pressed, wherein the range of heights varies based on the state the person support apparatus currently is in.

21. The person support apparatus of claim 1 further comprising:

a first actuator configured to pivot the backrest to different angular positions;

a second actuator configured to extend and retract the leg rest; and a third actuator configured to change an angular orientation of the seat; and wherein the control panel comprises no controls that move the first actuator without also simultaneously moving at least one of the second and third actuators.

* * * * *